US007614359B2

(12) United States Patent
Hasegawa et al.

(10) Patent No.: US 7,614,359 B2
(45) Date of Patent: Nov. 10, 2009

(54) COATING APPARATUS

(75) Inventors: Koji Hasegawa, Itami (JP); Hiroshi Matsuura, Itami (JP); Tetsuya Murakami, Amagasaki (JP); Takashi Sakamoto, Toyonaka (JP)

(73) Assignee: Kabushiki Kaisha Powrex, Osaka-Fu (JP)

( * ) Notice: Subject to any disclaimer, the term of this patent is extended or adjusted under 35 U.S.C. 154(b) by 0 days.

(21) Appl. No.: 10/526,787

(22) PCT Filed: Jul. 1, 2003

(86) PCT No.: PCT/JP03/08348

§ 371 (c)(1),
(2), (4) Date: Dec. 12, 2005

(87) PCT Pub. No.: WO2004/022246

PCT Pub. Date: Mar. 18, 2004

(65) Prior Publication Data

US 2006/0096527 A1 May 11, 2006

(30) Foreign Application Priority Data

Sep. 4, 2002 (JP) ..... 2002-259098

(51) Int. Cl.
*B05C 3/08* (2006.01)

(52) U.S. Cl. ..... 118/13; 118/19; 118/20; 118/303; 118/418; 99/494

(58) Field of Classification Search ..... 118/13, 118/19, 20, 303, 418; 34/108, 140, 237, 34/170, 131; 99/348, 494, 535; 427/242
See application file for complete search history.

(56) References Cited

U.S. PATENT DOCUMENTS

| | | | | |
|---|---|---|---|---|
| 3,936,534 | A * | 2/1976 | Schallis | 427/215 |
| 4,478,170 | A | 10/1984 | Bridges et al. | 118/64 |
| 4,581,242 | A | 4/1986 | Forster | 427/3 |
| 5,507,868 | A * | 4/1996 | Takei et al. | 118/19 |

FOREIGN PATENT DOCUMENTS

DE 2000-2002352 * 6/2001

(Continued)

*Primary Examiner*—Laura Edwards
(74) *Attorney, Agent, or Firm*—J.C. Patents

(57) ABSTRACT

The rotating drum 2 rotates around an axial line A that is inclined to the horizontal at a present angle θ. Process gas flows in the rotating a drum 2 from an air vent 7*a* of an air duct 7 through an air inlet 5 at one end of the rotating drum 2, passes through a layer of granules 11, and flows out into an air outlet duct 8 through an air vent 21*a* of a first disc plate 21 and a connection hole 22*a* in a second disc plate 22.

27 Claims, 17 Drawing Sheets

FOREIGN PATENT DOCUMENTS

| | | | |
|---|---|---|---|
| JP | 40-11964 | | 5/1965 |
| JP | S43-19511 | Y | 8/1968 |
| JP | S55-5491 | B | 2/1980 |
| JP | S56-7569 | U | 1/1981 |
| JP | 58-040136 | | 3/1983 |
| JP | 61-171563 | | 8/1986 |
| JP | 62-294461 | * | 12/1987 |
| JP | H01-41337 | B | 9/1989 |
| JP | 01-315329 | | 12/1989 |
| JP | 07-328408 | | 12/1995 |
| JP | 11-114407 | | 4/1999 |
| JP | 11-179184 | | 7/1999 |
| JP | 2000-126580 | | 5/2000 |
| JP | 2000-516523 | | 12/2000 |
| JP | 2001-058125 | | 3/2001 |

* cited by examiner

FIG. 6(a)
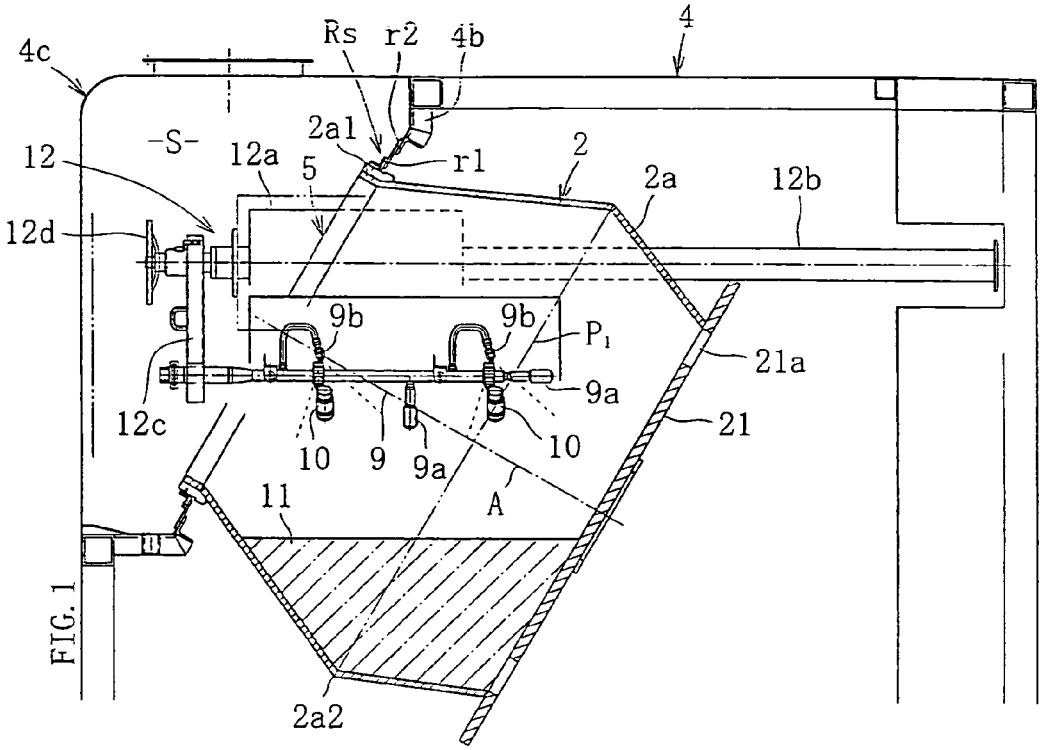
FIG. 1
FIG. 6(b)
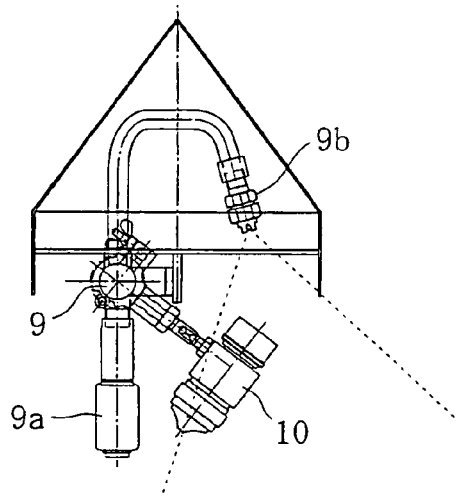

COATING APPARATUS

BACKGROUND OF THE INVENTION

The present invention relates to a coating apparatus for performing coating, mixing, drying, and the like of medical, food, pesticidal products, and the like that are in granular form, and more particularly to a coating apparatus having a rotating drum that is driven to rotate around its axial line.

Coating apparatus having a rotating drum has been used or performing film coating, sugar coating, and the like to medical, food, pesticidal products, and the like that are prepared as tablets, soft capsules, pellets, grains, and in other similar forms (hereinafter collectively referred to as "granules").

The following Patent Documents 1 to 7, for example, disclose this type of coating apparatus.

Patent Document 1 discloses a coating apparatus having a ventilated rotating drum 30 driven to rotate around a horizontal axial line A, as shown in FIG. 18. The rotating drum 30 is composed of a polygonal tube peripheral wall 30*c*, one end wall 30*a* formed in a polygonal pyramid shape extending from one end of the peripheral wall 30*c* in an axial direction toward one side, and the other end wall 30*b* formed in a polygonal pyramid shape extending from the other end of the peripheral wall 30*c* in the axial direction toward the other side. A porous plate 33 is attached to each face of the peripheral wall 30*c* so that the peripheral wall 30*c* is ventilated through the porous parts of the porous plates 33. A jacket 34 is attached on the outer periphery of each porous plate 33, and a ventilation channel 35 is formed between the jacket 34 and the porous plate 33.

At the other end of the rotating drum 30 where a rotary drive mechanism including a motor 36 and others is installed, a distributor 37 is disposed for controlling the ventilation of process gas such as dry air for the rotating drum 30. The distributor 37 has the function of communicating the ventilation channels 35 that have come to a preset location as the rotating drum 30 rotates to an air inlet duct 38 and to an air outlet duct 39, respectively.

For example, when one of the ventilation channels 35 comes to an upper part of the rotating drum 30 as it rotates, this ventilation channel 35 communicates to the air inlet duct 38, while, when one of the ventilation channels 35 comes to a lower part of the rotating drum, this ventilation channel 35 communicates to the air outlet duct 39. Thus, the process gas introduced from the air inlet duct 38 into the ventilation channel 35 at the upper part of the rotating drum 30 flows into the rotating drum 30 through the porous plate 33 at the upper part of the peripheral wall 30*c*, passes through inside a granule layer (rolling bed) 31, flows out into the ventilation channel 35 through the porous plate 33 at the lower part of the peripheral wall 30*c*, and is exhausted into the air outlet duct 39 through the ventilation channel 35.

Patent Documents 2 to 5 also disclose a coating apparatus having a ventilated rotating drum. Similarly to the apparatus of the Patent Document 1, porous parts are provided in a peripheral wall of the rotating drum for ventilation, and these porous parts are covered by jackets from outside, thereby forming ventilation channels therebetween.

The coating apparatus disclosed by any of Patent Document 6 and 7 has a rotating drum that is not ventilated. The rotating drum shown in the Patent Document 6 or 7 has a circular cross section and a bulged axial center; it is referred to as "an onion pan" because of its shape. Generally, this rotating drum is disposed such that its axial line is inclined to the horizontal. While the rotating drum itself is not ventilated, the ventilation of its inside is achieved through a supply pipe and an exhaust pipe. In the construction shown in FIG. 3 of Patent Document 6, for example, the supply pipe is inserted into the rotating drum from an opening at one end thereof for supplying air, while the exhaust pipe is connected to the opening at one end of the rotating drum for exhausting air. With such ventilation system, however, the process gas such as dry air makes contact only with the surface layer of the granule layer, because of which sufficient ventilation is not achieved to the inside of the granule layer. For this reason, Patent Document 6 shows another construction in FIG. 1 and FIG. 2 in which the air outlet of the exhaust pipe is embedded in the granule layer so as to allow the process gas to pass through inside the granule layer.

Further, as shown in Patent Documents 4 and 5, for example, it is the common practice to provide a baffle (mixing blade) on the inner face of the peripheral wall of the rotating drum in this type of coating apparatus so as to enhance the stirring and mixing effects for the granules to be processed (objects to be processed). The baffle is constructed with a metal plate baffle member formed in a predetermined shape fixed to the inner face of the peripheral wall using a bolt or mounting bracket (see Patent Document 5, for example). The baffle is hollow but its inner space is closed by the peripheral wall (Patent Document 4), or by a lid member (Patent Document 5).

[Patent Document 1] Japanese Patent Laid-Open Publication No. 2001-58125.

[Patent Document 2] Japanese Utility Model Publication No. Sho 43-19511.

[Patent Document 3] Japanese Patent Publication No. Hei 1-41337.

[Patent Document 4] Japanese Patent Laid-Open Publication No. Hei 7-328408.

[Patent Document 5] Japanese Utility Model Laid-Open Publication No. Sho 56-7569.

[Patent Document 6] Japanese Patent Publication No. Sho 55-5491.

[Patent Document 7] Japanese Patent Laid-Open Publication No. Sho 58-40136.

The coating apparatuses shown in Patent Documents 1 to 5 tend to require an elaborate cleaning process after completion of a coating process particularly for the cleaning of the ventilation channels on the inside because of the structure in which the rotating drum is ventilated through the porous parts (or air holes) provided in the peripheral wall, with the ventilation channels being formed between the porous parts and the jackets covering the same from outside.

Moreover, when performing validation on the inside of the ventilation channels after the cleaning, or when wiping off powder or the like of abraded granule particles adhered inside the ventilation channels, the jackets forming the ventilation channels must be removed and then mounted again after the completion of a required procedure, which is troublesome.

Furthermore, when coating granules with sugar liquid or chocolate paste, for example, the rotating drum should preferably be kept at a lower temperature than that of the granules (or objects to be processed) in the case of sugar coating, or at a higher temperature than that of the granules in the case of chocolate coating, in order to prevent these coating materials from adhering on the inner wall of the rotating drum, but the coating apparatuses shown in Patent Documents 1 to 5 cannot be cooled or heated from outside of the rotating drum because the ventilation channels are provided on the outside of the rotating drum. Adhesion of coating material on the inner wall of the rotating drum will cause a complex cleaning or validation process after the coating process, and also lead to a loss of the coating material and a decrease in the product yield.

The coating apparatuses shown in Patent Documents 6 and 7 use a supply pipe and an exhaust pipe for the ventilation of the rotating drum on the inside because the rotating drum itself is not ventilated. The apparatuses thus entail the following problems: If the air vents of the supply pipe and exhaust pipe are located outside the granule layer, the process gas such as dry air cannot provide ventilation for the inside of the granule layer and it takes a long time to dry the granules, or, the granules may be dried unevenly, resulting in deterioration of the coating quality. On the other hand, if the air vent of the supply pipe or exhaust pipe is embedded in the granule layer so as to resolve this problem, powder or the like of abraded granule particles or coating liquid may adhere to the supply pipe or exhaust pipe and clog the air vent, leading to ventilation failure and requiring a complex cleaning process after the coating process, or it may cause contamination. Also, the supply pipe or exhaust pipe embedded inside will inhibit smooth flow of the granule layer and may cause deterioration of the coating quality.

With the coating apparatuses shown in Patent Documents 6 and 7, on the other hand, the rotating drum can be cooled or heated from outside, but if the rotating drum includes a baffle, sufficient cooling or heating of the baffle cannot be expected. Thus there is a problem that coating material such as sugar liquid or chocolate paste tends to stick to the baffle.

SUMMARY OF THE INVENTION

An object of the present invention to provide a coating apparatus that is excellent in the ease of cleaning and validation after the cleaning.

Another object of the present invention is to provide a coating apparatus that is excellent in the quality and efficiency of the coating process.

To achieve the above objects, the present invention provides a coating apparatus including a ventilated rotating drum in which granules to be processed are accommodated and which is driven to rotate around its axial line, wherein the rotating drum includes one end and the other end along an axial direction and a peripheral wall that connects the one end and the other end, the other end being located on the side of a rotary drive mechanism for driving the rotating drum; the one end and the other end respectively provided with air vent, one of which constitutes an air inlet for supplying process gas from outside into the rotating drum, and the other one of which constitutes an air outlet for exhausting the process gas from inside the rotating drum to the outside; and the process gas supplied into the rotating drum through the air inlet is passed through a layer of granules inside the rotating drum and exhausted from the air outlet.

The rotating drum is a ventilated type, but the air vents are provided at one end and the other end, and no air passages (or porous parts) are provided in the peripheral wall for the ventilation. Accordingly, a complex ventilation structure need not be provided as with the conventional ventilated rotating drum, in which the air passages (or porous parts) in the peripheral wall are covered by jackets from outside and ventilation channels are formed therein. That is, the coating apparatus of the present invention includes a ventilated rotating drum that does not include air passages (or porous parts) in its peripheral wall for the ventilation, or in other words, the rotating drum has an air-tight structure in the peripheral wall, and is not provided with ventilation channels covered by jackets on the outside of the peripheral wall. Thus the coating apparatus enables easier and more reliable cleaning and validation after the cleaning, as compared to the conventional apparatuses.

One of the air vents at one end and the other end is used as an air inlet, while the other is used as an air outlet; process gas (such as hot air and cool air) is supplied into the rotating drum from the air inlet at one or the other end, passed through the granule layer inside the rotating drum, and exhausted from the air outlet at one or the other end. Thus, sufficient ventilation is provided inside the granule layer, whereby processing of the granule layer such as drying is evenly achieved.

Also, the rotating drum can be cooled or heated from the outside of the peripheral wall, so that the rotating drum may be cooled during sugar coating, for example, using cooling means such as cool water or air, or, it may be heated during chocolate coating using heating means such as hot water or hot air or a heater, whereby adhesion of coating materials on the inner wall of the rotating drum can be prevented. Thereby, the failure rate or the coating products can be reduced and the product yield increased, as well as the loss of coating materials can be reduced, and moreover, the cleaning process of the rotating drum on the inside after the coating process is made easy. The rotating drum may be heated during film coating, too, so as to prevent heat dissipation of the process gas (such as dry air) and enhance the drying efficiency, or when using a heat-sensitive coating material, the rotating drum may be cooled so as to prevent adhesion of the coating material on the inner wall of the rotating drum. Thus, with the coating apparatus of the present invention, various coating processes such as film coating, sugar coating, and chocolate coating can be performed with high quality and efficiency.

At least one of the cooling means and the heating means should preferably be disposed on the outside of the peripheral wall of the rotating drum, for cooling, for heating the rotating drum. As the cooling means, for example, a nozzle or the like may be employed for spraying cooling water or cool air to the outside of the peripheral wall, and as the heating means, for example, a nozzle or the like may be employed for spraying hot water or air to the outside of the peripheral wall. A heater such as an infrared heater or the like may also be employed as the heating means. When cooling or heating the rotating drum, the temperature of the granule layer inside the rotating drum may be measured by some suitable means such as a temperature sensor, and the cooling or heating means may be controlled (the temperature or flow rate of the cooling or heating medium, or the current value or the like may be controlled) based on the measurement results so that the granule layer is kept at a desired temperature.

The rotating drum is disposed such that its axial line and the horizontal form a present angle $\theta$ ranging from 0° to 90°. That is, the rotating drum is operated in the orientation selected from the following: The state in which the axial line is parallel to the horizontal ($\theta=0°$), the state in which the axial line is parallel to the vertical ($\theta=40°$), and the state in which the axial line is inclined to the horizontal ($0°<\theta<90°$). Further, the angle $\theta$ of the axial line of the rotating drum during the coating process of the granules may be changed when discharging granule products or cleaning the rotating drum.

Preferably, the rotating drum should be disposed such that its axial line is inclined to the horizontal at a preset angle $\theta$. In this case, the preferable range of inclination angle $\theta$ of the axial line is $20°\leqq\theta\leqq70°$, and more preferably $30°\leqq\theta\leqq45°$; the angle $\theta$ should most preferably be set 30° or 45°.

Because the axial line of the rotating drum is inclined to the horizontal at a preset angle $\theta$, the volume of the granules that can be processed inside the rotating drum is larger; the production efficiency is improved because of the increased amount of granules per one processing cycle. Further, as the rotating drum rotates around the inclined axial line, an axial movement is imparted to the flow of the granules accommodated inside the rotating drum in addition to the movement in the rotating direction with the rotation of the rotating drum, whereby high stirring and mixing effects are achieved for the granule layer; even with a rotating drum that does not have a baffle (mixing blade) inside, for example, sufficient stirring and mixing effects are achieved. Of course, with the use of a baffle, even higher stirring and mixing effects are achieved. In the case in which the axial line of the rotating drum is inclined, the rear end part of the rotating drum is normally positioned on the lower side.

If a baffle is to be provided inside the rotating drum, the conventional structure may be used for the baffle, but preferably, the baffle should be provided such as to protrude inward from the peripheral wall of the rotating drum, and the inner space of this baffle should be opened on the outside of the peripheral wall. Because of the inner space of the baffle opened on the outside of the peripheral wall, the baffle can be heated or cooled sufficiently when the rotating drum is cooled or heated from the outside of the peripheral wall. Accordingly, adhesion of coating materials on the inner wall of the peripheral wall and on the baffle can be prevented effectively.

The above baffle should preferably be provided in the peripheral wall continuously inward. In this case, the peripheral wall appears to be indented in the baffle when seen from outside. Thus the baffle can be cooled or heated effectively from the outside of the peripheral wall. Such baffle can be formed, for example, by fixing a baffle member formed in a predetermined shape to the edge of notches provided in a preset area of the peripheral wall. Alternatively, the baffle can be formed by bending a preset area or the peripheral wall inward. That is, the baffle can be formed in one piece with the peripheral wall. One specific example of the method to achieve this is plastic forming such as press forming of the metal plate constituting the peripheral wall.

Irrespective of the orientation or the angle θ of the rotating drum, the stirring and mixing effects for the granule layer achieved during the rotation of the rotating drum can be enhanced by forming the peripheral wall in a polygonal tube shape having a polygonal cross section (this shape of the peripheral wall hereinafter referred to as "polygonal shape"), or, by forming the peripheral wall in such a shape that its diameter increases gradually from one end and the other end toward the center of the axial direction, with a cross-sectional plane containing a large-diameter part of the peripheral wall being inclined to the axial line at a preset angle (this shape of the peripheral wall hereinafter referred to as "irregular shape"). In the case in which the peripheral wall has the polygonal shape, the granules inside are lifted up to the front of the rotating direction by each face of the peripheral wall during the rotation of the rotating drum, after which they return to the back of the rotating direction by their self-weight, in a repeated manner. The flow of the granule layer is thus intensified in the rotating direction. In the case in which the peripheral wall has the irregular shape, on the other hand, the large diameter part of the peripheral wall constantly changes its position relative to the granule layer in the axial direction during the rotation of the rotating drum, whereby an axial movement is imparted to the granules inside in addition to the movement in the rotating direction. The flow of the granule layer is thus intensified in the rotating direction and the axial direction. It should be noted that the rotating drum may have a cylindrical peripheral wall (with a circular cross section).

By applying any two features selected from the three, i.e., the inclined axial line, the peripheral wall with the polygonal shape, and the peripheral wall with the irregular shape, to the rotating drum, and preferably by applying all these three features to the rotating drum, excellent stirring and mixing effects can be achieved.

Good stirring and mixing effects can also be achieved by making the axial line of the rotating drum oscillate within a preset angle range. This arrangement should preferably be employed with the polygonal and/or irregular shape of the peripheral wall. The oscillating angle range of the axial line of the rotating drum may suitably be set in accordance with the layout of the entire apparatus or processing conditions; preferably, the axial line should be inclined at an angle θ of 45° and oscillated in the range of from 20° to 70°.

The air vent at the other end of the rotating drum may be constituted by a porous part. The porous part includes a multiplicity of air holes of a size that does not allow each circle, triangle, or square, or of multiplicity of regularly arranged slots or slits, or, it may be formed of a porous member such as sintered metal. The air vent at one end of the rotating drum, on the other hand, may be provided in an opening whose center coincides with the axial line of the rotating drum. Thereby, granules to be processed can be poured into the rotating drum, and various members such as spray nozzles or the like can be moved in and out, through the opening at one end, and moreover, inspection or validation after the cleaning of the rotating drum on the inside can readily be performed.

A ventilation mechanism may be provided at the other end of the rotating drum for communicating the air vent at the other end to an air duct at a preset location. The location where the air vent at the other end communicates to the air duct is set at least such that the process gas supplied into the rotating drum through the air vent at one end is passed through inside the granule layer and exhausted into the air duct through the air vent at the other end, or, the process gas supplied into the rotating drum from the air duct through the air vent at the other end is passed through inside the granule layer and exhausted through the air vent at one end.

The above ventilation system may be constructed, for example, with first disc plate constituting the other end of the rotating drum and having an air vent consisting of porous parts arranged in a ring shape around the axial line or the rotating drum, and a second disc plate arranged opposite the first disc plate and having a connection hole for communicating the air vent of the first disc plate to the air duct at a preset location. The air vent of the first disc plate may be formed either by fixing a plate member having a porous part as mentioned above to the first disc plate, or, by forming such porous part directly in the first disc plate. The first disc plate rotates with the rotating drum, while the second disc plate does not. During the rotation of the rotating drum, the air vent of the first disc plate communicates to the air duct only at the position of the connection hole of the second disc plate. In this case, the second disc plate may be constructed slidable in the axial direction so as to enable easy and reliable cleaning and validation after the cleaning of the air vent of the first disc plate, the connection hole of the second disc plate, and the opposing faces of both disc plates. Further, sealing means (such as a labyrinth seal, for example) should preferably be provided between the opposing faces of both disc plates so as to seal the air vent and connection hole from outside air.

Alternatively, the above ventilation mechanism may be constructed such that the air vent at the other end of the rotating drum communicates to a first air duct at a first preset location where the air vent overlaps the granule layer inside the rotating drum, and to a second air duct at a second preset location where the air vent overlaps an upper space above the granule layer inside the rotating drum. In this case, either one of the first preset location and second preset location is selected when performing ventilation. When the first preset location is selected, the process gas flows through the granule layer between the air vent at the other end at the first preset location and the air vent at one end. When the second preset location is selected, the process gas flows through the upper space above the granule layer between the air vent at the other end at the second preset location and the air vent at one end. That is, when the second preset location is selected, the process gas supplied into the rotating drum does not flow through the granule layer but passes through the upper space thereabove, and is exhausted. This system is particularly suitable for sugar coating.

More specifically, sugar coating generally includes a process of spraying and adhering coating liquid onto granule particles (such as tablets) without ventilation (spraying process), a process of spreading the coating liquid adhered on the granule particles over the surface thereof by rolling movement of the granule layer without ventilation (pausing process), and a process of performing ventilation with process gas (drying gas) to dry the coating liquid spread on the surface of the particles (drying process). Of these, if the processing time of the pausing process is prolonged, the granule particles tend to absorb the moisture as the humidity inside the rotating drum rises because of moist vapor of the coating liquid, leading to wet abrasion of the particles, or causing the drying process to require a longer time for the drying. Therefore, to prevent this trouble, there is sometimes provided an additional process of ventilating a relatively low-temperature (e.g. room temperature) process gas (such as cool air) (referred to as "second pausing process"), following the pausing process in which no ventilation is performed (referred to as "first pausing process"). However, if the process gas is passed through the granule layer in this second pausing process, depending on the properties of coating liquid or ventilation conditions, the coating liquid may be dried before it is sufficiently spread, i.e., the coating quality may be adversely affected.

With the above construction, by selecting the second preset location, the process gas (such as cool air) supplied into the rotating drum can be passed through the upper space above the granule layer and not through inside it, and exhausted, in the second pausing process. As the process gas flows through the upper space above the granule layer, the moist vapor filled in the upper space above the granule layer is exhausted to the outside of the rotating drum with the process gas. Thus the problems such as wet abrasion or granule particles caused by absorption of the moisture and an increase in the time required for the drying are resolved, and moreover, because the process gas does not flow through the granule layer, no failure occurs in the spreading of the coating liquid. When performing the drying process after the second pausing process, the inside of the granule layer can be dried sufficiently with good efficiency by selecting the first preset location, whereby high quality coating of the dried granule products is achieved.

The coating apparatus of the present invention may further include a product discharge part for discharging granule products inside the rotating drum to the outside. The product discharge part may be provided in the rear end part of the rotating drum, e.g., in the first disc plate, such that it can be opened and closed. More specifically, the product discharge part may be constructed with an open window formed in the first disc plate and an open/close lid provided for the open window. The open window is provided, for example, in the air vent of the first disc plate arranged in a ring shape, at one or a plurality of circumferentially spaced locations. The open/close lid should preferably be formed of a porous member so that the provision of the open/close lid does not cause a decrease in the area of the air vent. The open/close lid is normally closed; it is opened to open the open window when the granule products are discharged.

For example, when the open/close lid is opened in a state wherein the second disc plate is separated from the first disc plate, the granule products inside the rotating drum are discharged by self-weight through the open window to the outside. By rotating the rotating drum at this time, the granule products can entirely be discharged with good efficiency.

The opening/closing operation of the open/close lid is associated with, for example, a movement of a movable member of an actuator and a sliding movement of the second disc plate. The actuator may be, for example, a fluid pressure cylinder such as an air cylinder, in which case the piston rod of the cylinder is the movable member.

Another arrangement that may be employed for the product discharge part is to cause the granule products inside the rotating drum to be discharged to the outside through inside a hollow drive shaft that is connected to the other end of the rotating drum. In this case, the hollow drive shaft should preferably be provided with an open/close lid for opening and closing an opening at one shaft end facing the inside of the rotating drum. Further, a convex discharge guide part should preferably be provided at the other end of the rotating drum, for faster discharge of the granule products. The discharge guide part will scoop up the granules inside and guide them toward the opening at the shaft end, as the rotating drum rotates.

In the above construction, one end of the rotating drum should preferably be covered by a part of casing to which a third air duct is attached, with sealing means for providing a seal between the one end and part of the casing. With this construction, the flow passage of the process gas between the air vent of the third air duct and the air vent at one end of the rotating drum is sealed from outside air by the part of the casing and sealing means. The sealing means may be a contact seal, but should preferably be a labyrinth seal so as to prevent wear deterioration caused by repeated contact and to secure long seal life.

BRIEF DESCRIPTION OF THE DRAWINGS

FIG. 6(*a*) is a partial longitudinal cross-sectional view showing the surrounding part of the rotating drum inside the casing, and FIG. 6(*b*) is an enlarged front view of major parts thereof;

Figure 11:
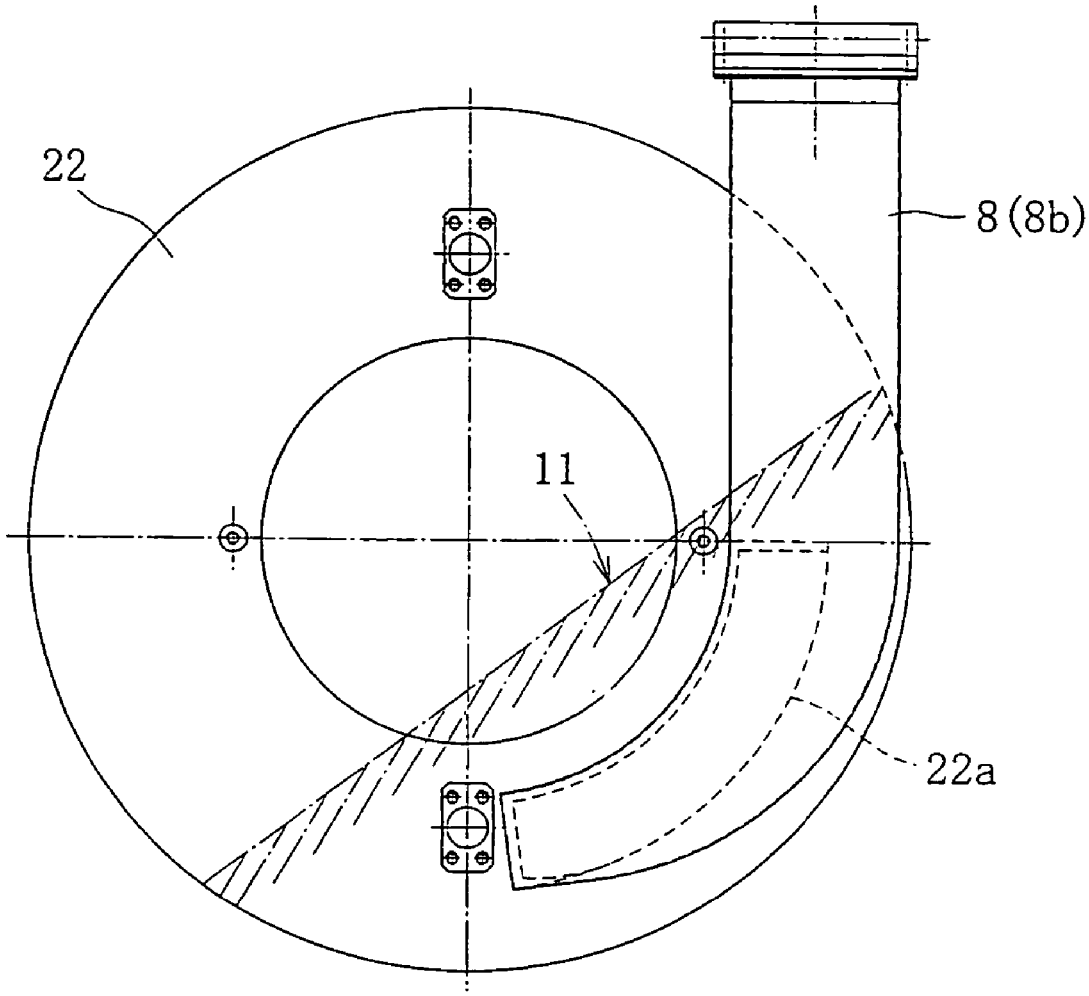
Figure 12:
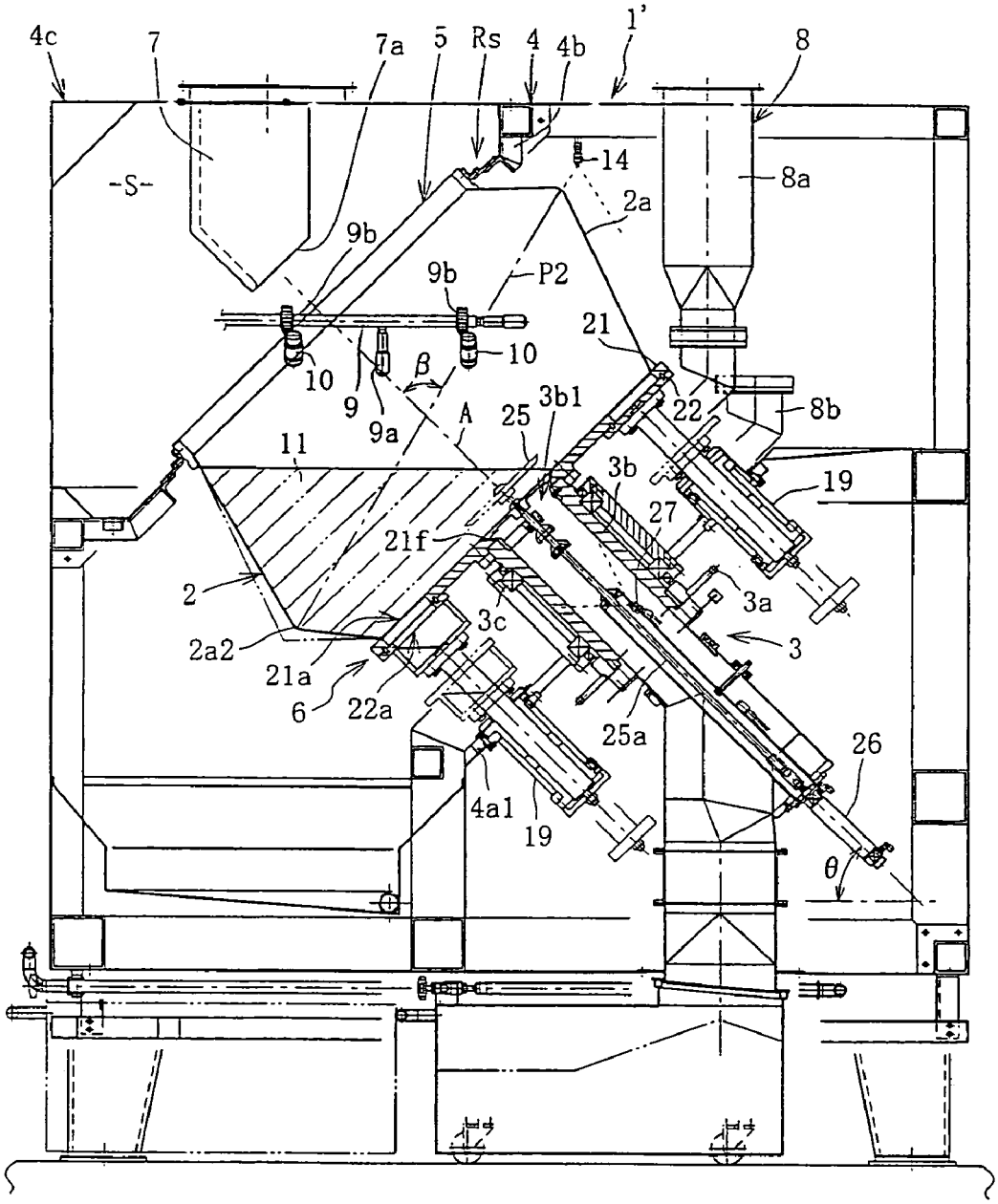
Figure 13:
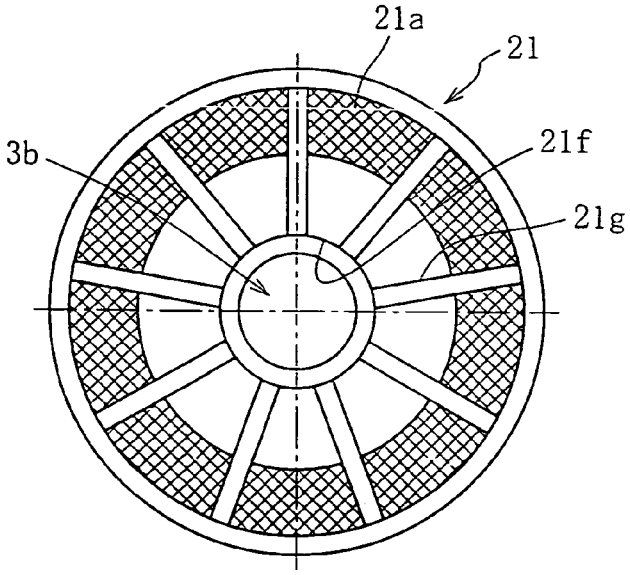
Figure 14:
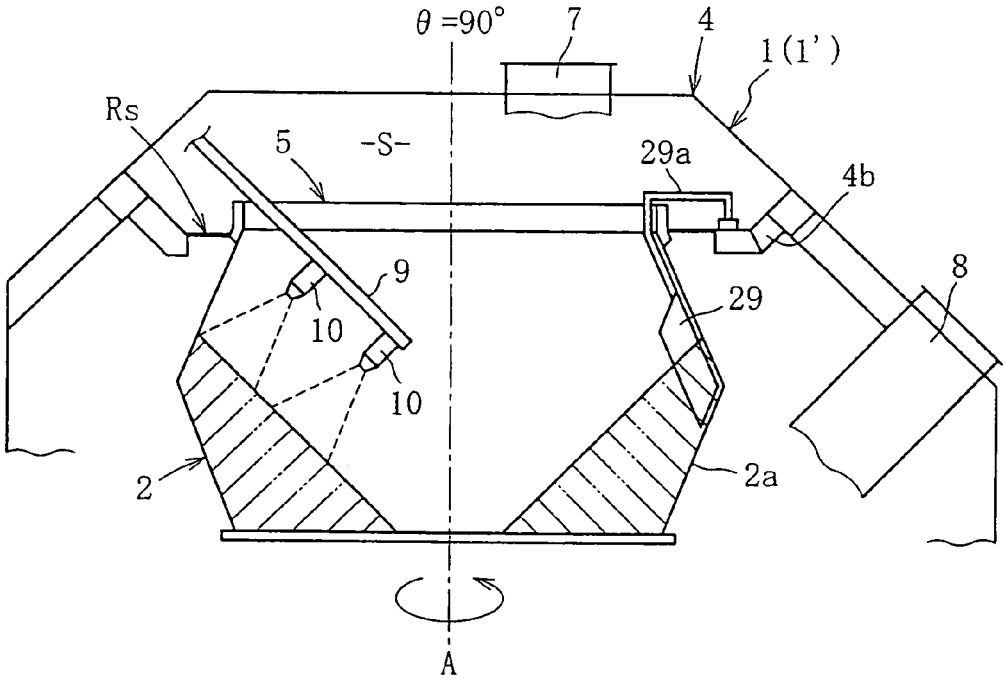
Figure 15:
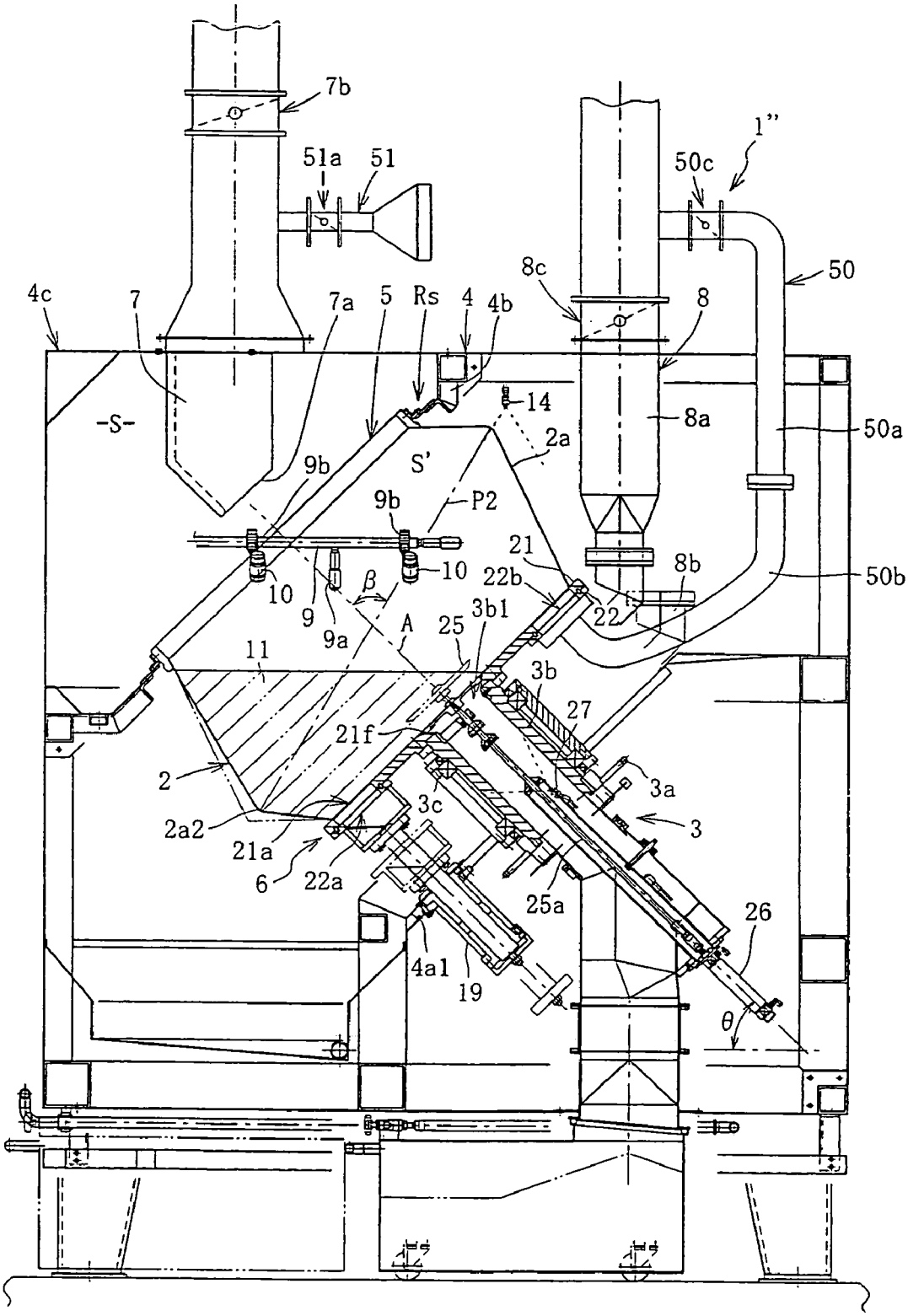
Figure 16:
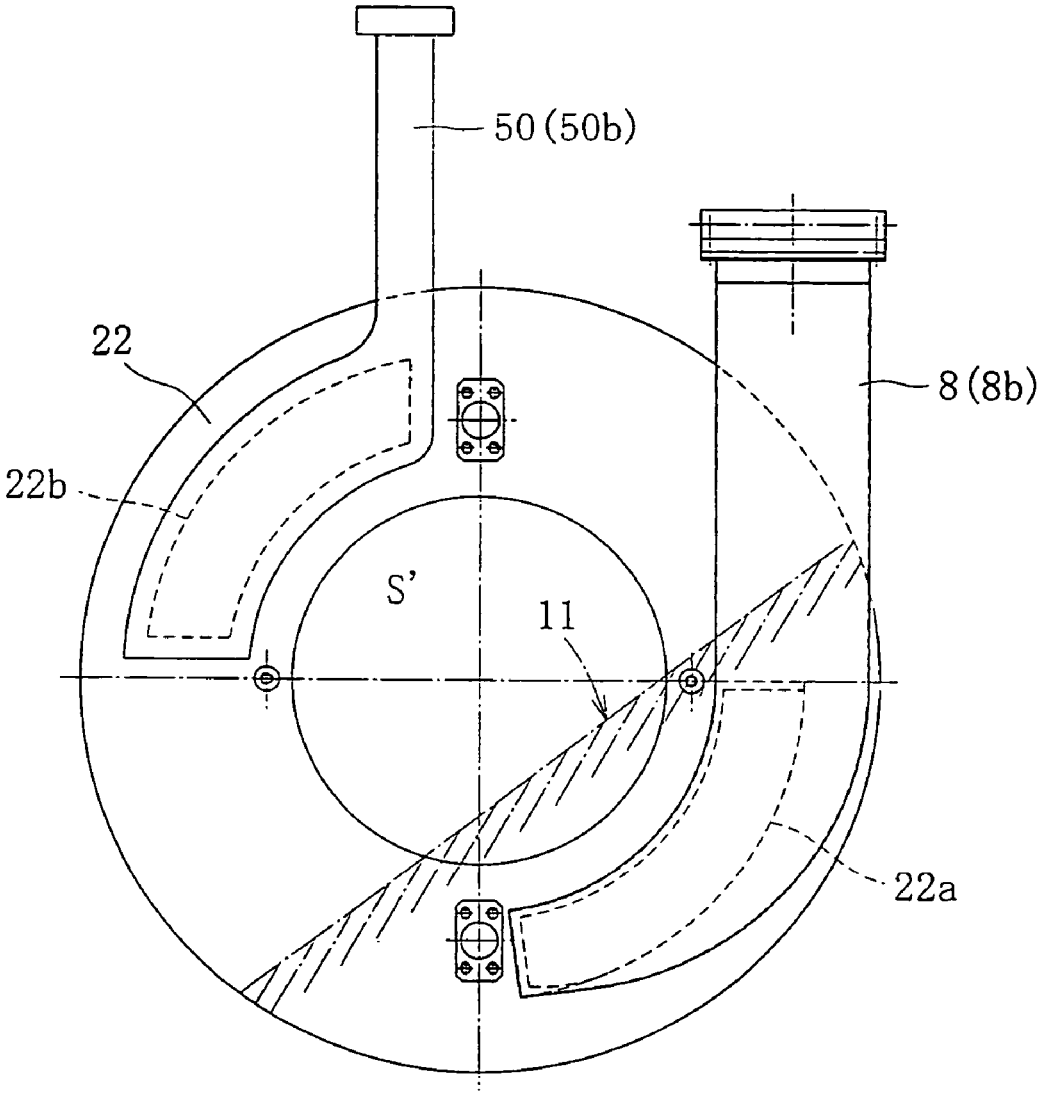
Figure 17A:
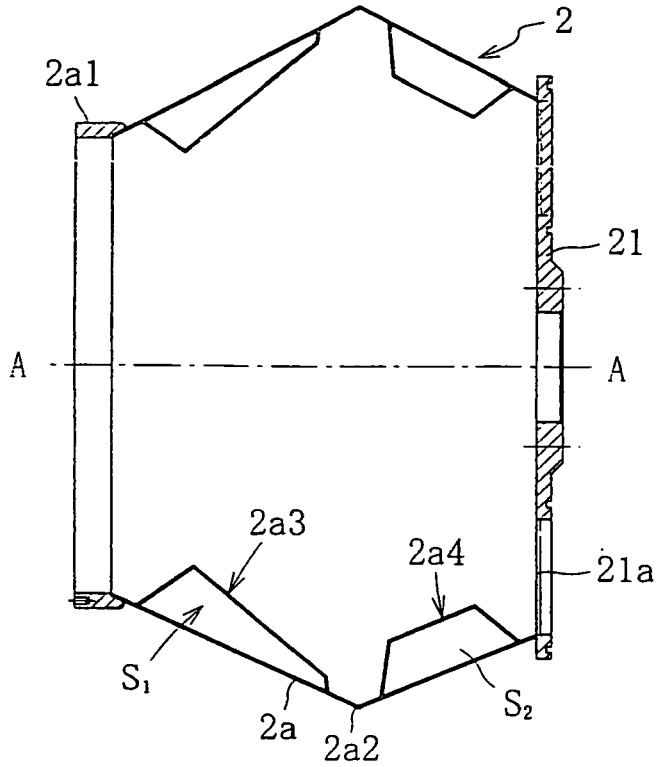
Figure 17B:
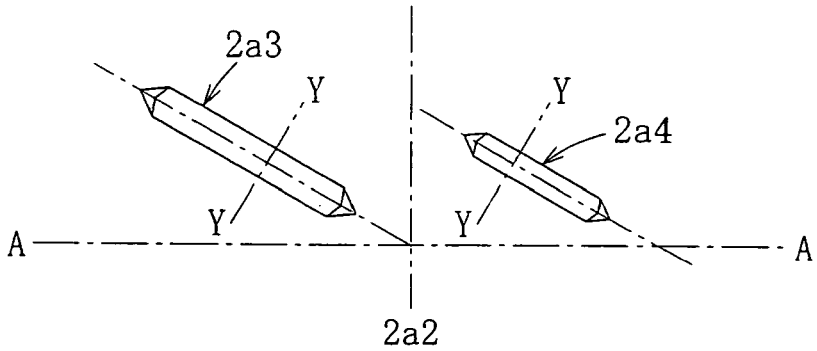
Figure 17C:
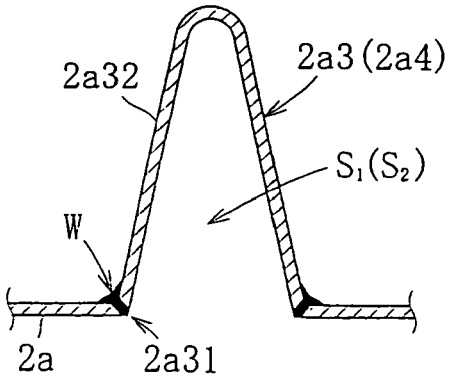
Figure 17D:
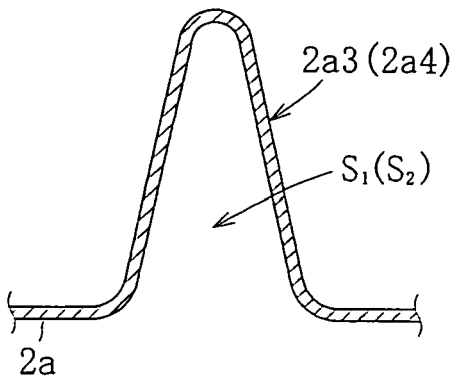
Figure 18:
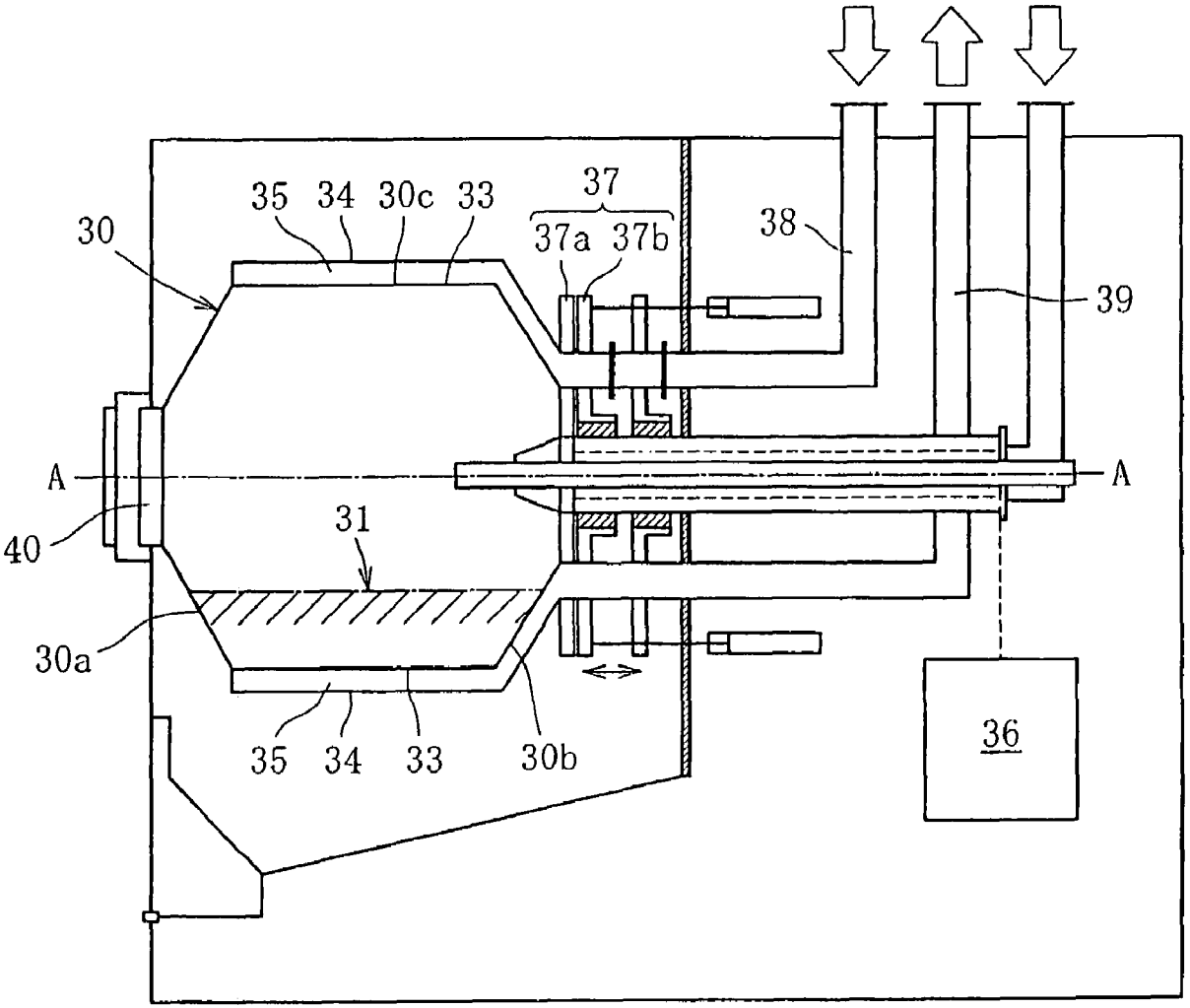

is a partial longitudinal cross-sectional view for explaining how the open/close lid is opened and closed;

FIG. 11 is a view of a second disc plate seen from behind;

FIG. 12 is a partial longitudinal cross-sectional view showing the overall construction of a coating apparatus according to a second embodiment;

FIG. 13 is a front view showing a first disc plate seen from the front;

FIG. 14 is a conceptual view showing one example in which the axial line of the rotating drum is parallel to the vertical (θ=90°);

FIG. 15 is a partial longitudinal cross-sectional view showing the overall construction of a coating apparatus according to a third embodiment;

FIG. 16 is a view of a second disc plate seen from behind;

FIG. 17 shows one example in which baffles are provided in the peripheral wall of the rotating drum, being a longitudinal cross-sectional view of the rotating drum; FIG. 17(*b*) shows one example in which baffles are provided in the peripheral wall of the rotating drum, being a top plan view of the baffles seen from the inner side. FIGS. 17(*c*)-17(*d*) show examples in which baffles are provided in the peripheral wall of the rotating drum, being a cross section of the baffles taken along the line Y-Y of FIG. 17(*b*); and FIG. 18 is a longitudinal cross-sectional view showing a conventional coating apparatus.

DETAILED DESCRIPTION OF THE INVENTION

Various embodiments of the present invention will be hereinafter described with reference to the accompanying drawings.

Figure 1:
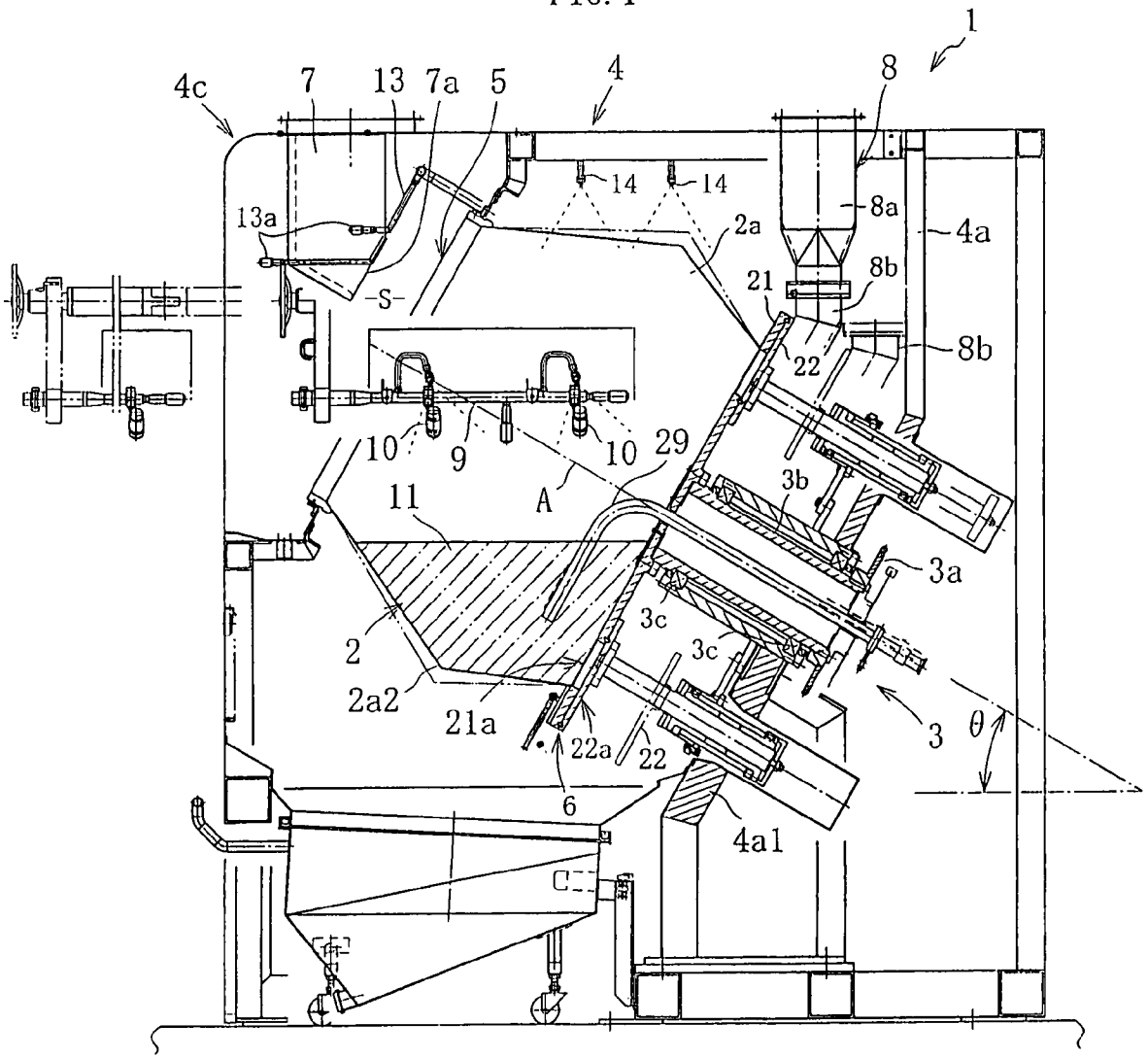
FIG. 1 is a parallel longitudinal cross-sectional view showing the overall construction of a coating apparatus according to a first embodiment.

FIG. 1 shows a coating apparatus 1 according to a first embodiment. The coating apparatus 1 includes a rotating drum 2 disposed such as to be rotatable around an axial line A that is inclined to the horizontal at a preset angle θ of, for example, 30°, and a rotary drive mechanism 3 for driving the rotating drum 2 in forward and/or reverse directions; these rotating drum 2 and rotary drive mechanism 3 are accommodated inside a casing 4.

Figure 3:
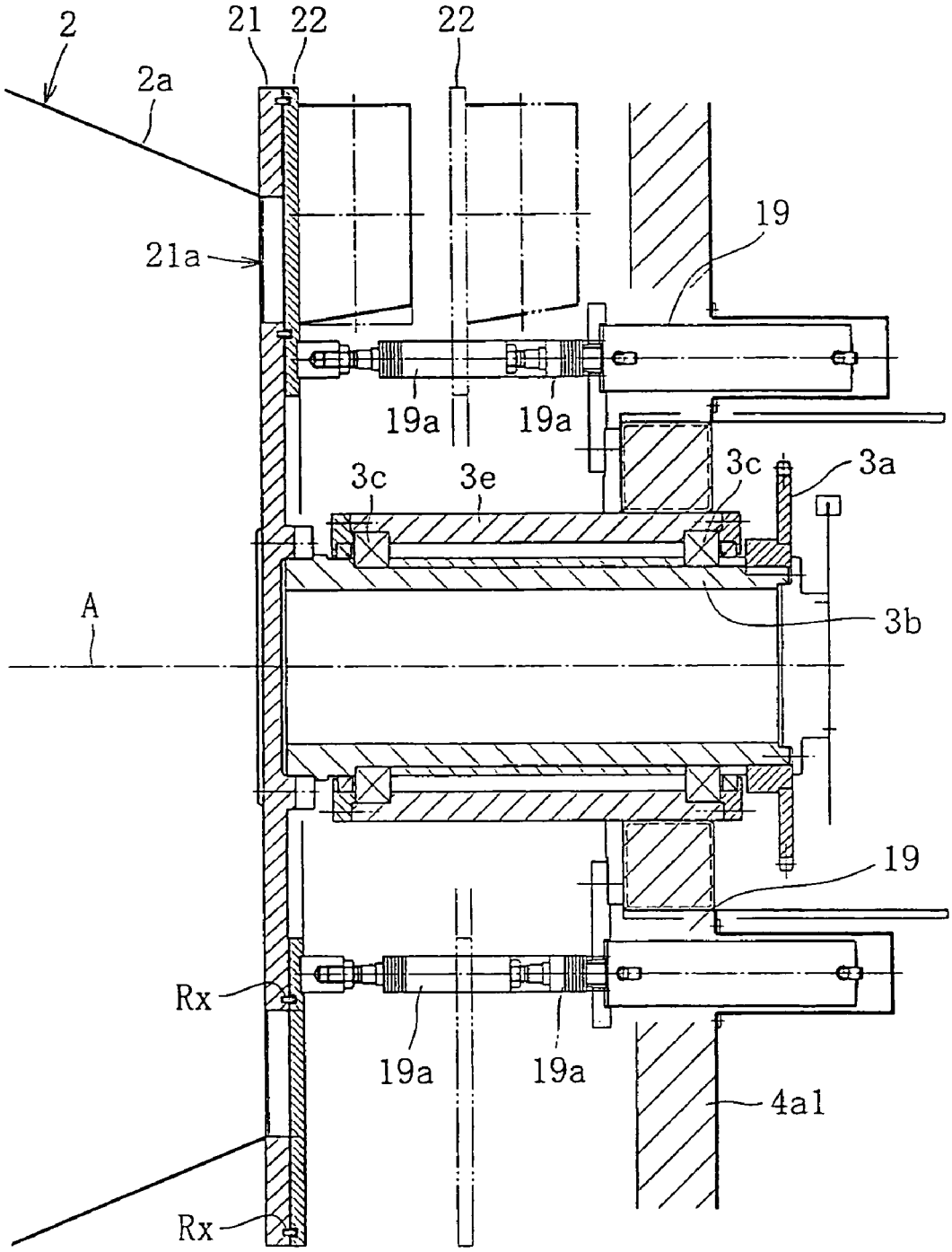
FIG. 3 is a partial longitudinal cross-sectional view showing a rear part of a rotating drum.
Figure 4:
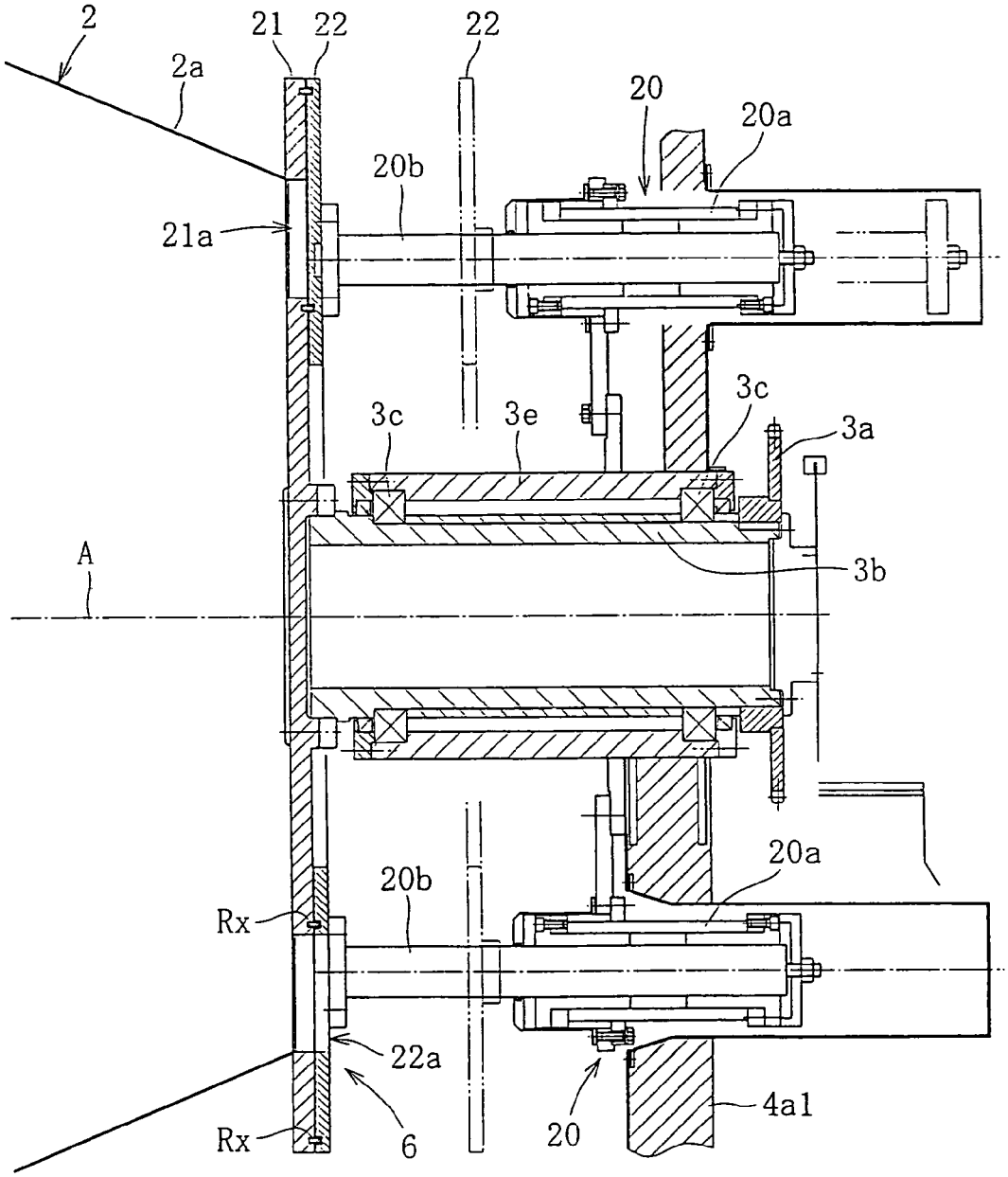
FIG. 4 is a partial longitudinal cross-sectional view showing the rear part of the rotating drum.

The rotary drive mechanism 3 has, by way of example, a construction that reduces the rotating force of a drive motor using a reduction gear and inputs the same to a hollow drive shaft 3*b* that is connected to the rear end, or the lower side end, of the inclined rotating drum 2, via a chain (not shown) and a sprocket 3*a*. In this construction, the drive shaft 3*b* and rotating drum 2 are rotatably supported by bearings 3*c* in an inclined wall 4*a*1, which is orthogonal to the axial line A, of an inner vertical wall 4*a* of the casing 4. More specifically, a cylindrical housing 3*e* is fixed to the inclined wall 4*a*1, the drive shaft 1*b* being inserted into the inner bore of the cylindrical housing 3*e* so that it is supported rotatably by the bearings 3*c*, as shown in FIG. 3 and FIG. 4. The sprocket 3*a* is attached to the rear end of the drive shaft 3*b* so as to be rotatable therewith.

Figure 5:
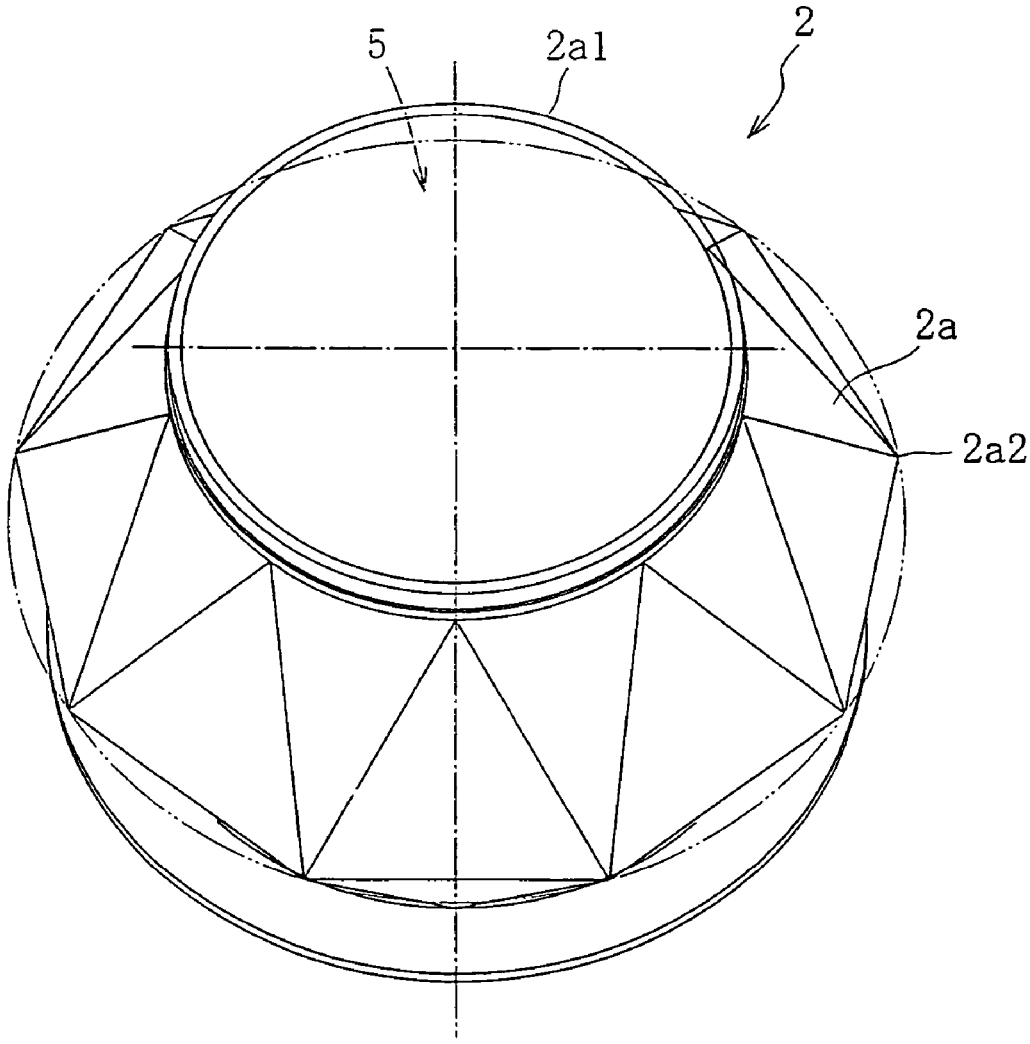
FIG. 5 is a perspective view illustrating the rotating drum.

The rotating drum 2 includes, along its axial line, a front end part (upper side and), rear end parts (lower side end), and peripheral wall 2*a* that connects the front end part and rear end part, as shown in FIG. 5 and FIG. 6(*a*). In this embodiment, the peripheral wall 2*a* is formed in a polygonal tube, i.e., it has a polygonal cross section, with its diameter gradually increasing from the sides of the front and rear end parts toward the center of the axial line. A cross-sectional plane P1 containing the large diameter part 2*a*2 of the peripheral wall 2*a* is a polygon (e.g. nonagon) that is orthogonal to the axial line A. The peripheral wall 2*a* is formed of a metal plate such as stainless steel sheet that has no air holes or porous parts; both sides of the large diameter part 2*a*2 where the diameter decreases gradually toward the front end part and rear end part are respectively formed by a plurality of triangles that have their apexes oriented to the front and to the back and are arranged alternately along the circumferential direction. The front end part is constructed with a circular part 2*a*1, while the rear end part is constructed with a first disc plate 21 that forms a ventilation system 6 to be described later. The front end part is entirely open, thus forming an air vent 5 for the process gas such as dry air (either hot or cool).

At the corner 4*c* at the upper front of the casing 4, or more specifically, in the upper wall near the corner 4*c* opposite the front end part of the rotating drum 2 is mounted an air duct 7, as shown in FIG. 1. Also, in the upper wall in the rear of the casing 4, or more specifically, in the upper wall of the casing 4 above the rear end part of the rotating drum 2 is mounted another air duct 8.

The air duct 7 has an air vent 7*a* that is arranged at a location opposite the upper part of the air vent 5 (upper half of the air vent 5 above the axial line A) at the front end part or the rotating drum 2. In this embodiment, the air vent 5 at the front end part of the rotating drum 2 and the air vent 7*a* of the air duct 7 face each other at some distance. In the upper front of the casing 4 is formed a passage space S of the process gas that contains both air vents 5 and 7*a*, and this space S is sealed from the outside air. More specifically, as shown in FIG. 6(*a*), an annular inner seal member r1 is fitted to the outer periphery of the circular part 2*a*1 at the front end part of the rotating drum 2, and an annular outer seal member r2 is fitted to the inner periphery of a partition wall 4*b* that is fixed to the upper, front, and left and right side walls of the casing 4 opposite the front end part, and these inner seal member r1 and outer seal member r2 constitute a labyrinth seal Rs. The passage space S located in the upper front of the partition wall 4*b* and labyrinth seal Rs is thus sealed from the outside air. The air vent 5 of the rotating drum 2 and the air vent 7*a* of the air duct 7 open inside the passage space S, respectively.

Approximately in the middle inside the rotating drum 2 is disposed a detergent feed pipe 9 that extends substantially horizontally to the front and back. Spin balls 9*a* are connected to the detergent feed pipe 9 approximately in middle and at the rear end in the axial direction, and fan nozzles 9*b* are connected respectively at locations on both sides spaced a certain distance from around the middle of the axial direction. To the detergent feed pipe 9 are further attached spray nozzles 10 (see FIG. 6(*b*)) connected to a spray liquid feed tube (not shown) near the fan nozzles 9*b*. The detergent feed pipe 9 thus doubles as supporting means of the spray nozzles 10. The spin balls 9*a* spray the detergent in a spherical pattern all over the interior of the rotating drum 2, the fan nozzles 9*b* spray detergent onto the spray nozzles 10 and for the cleaning of the rotating drum 2 on the inside, and the spray nozzles 10 spray a liquid such as coating liquid toward the granule layer (rolling bed of the granules) 11 formed inside the rotating drum 2.

Figure 2:
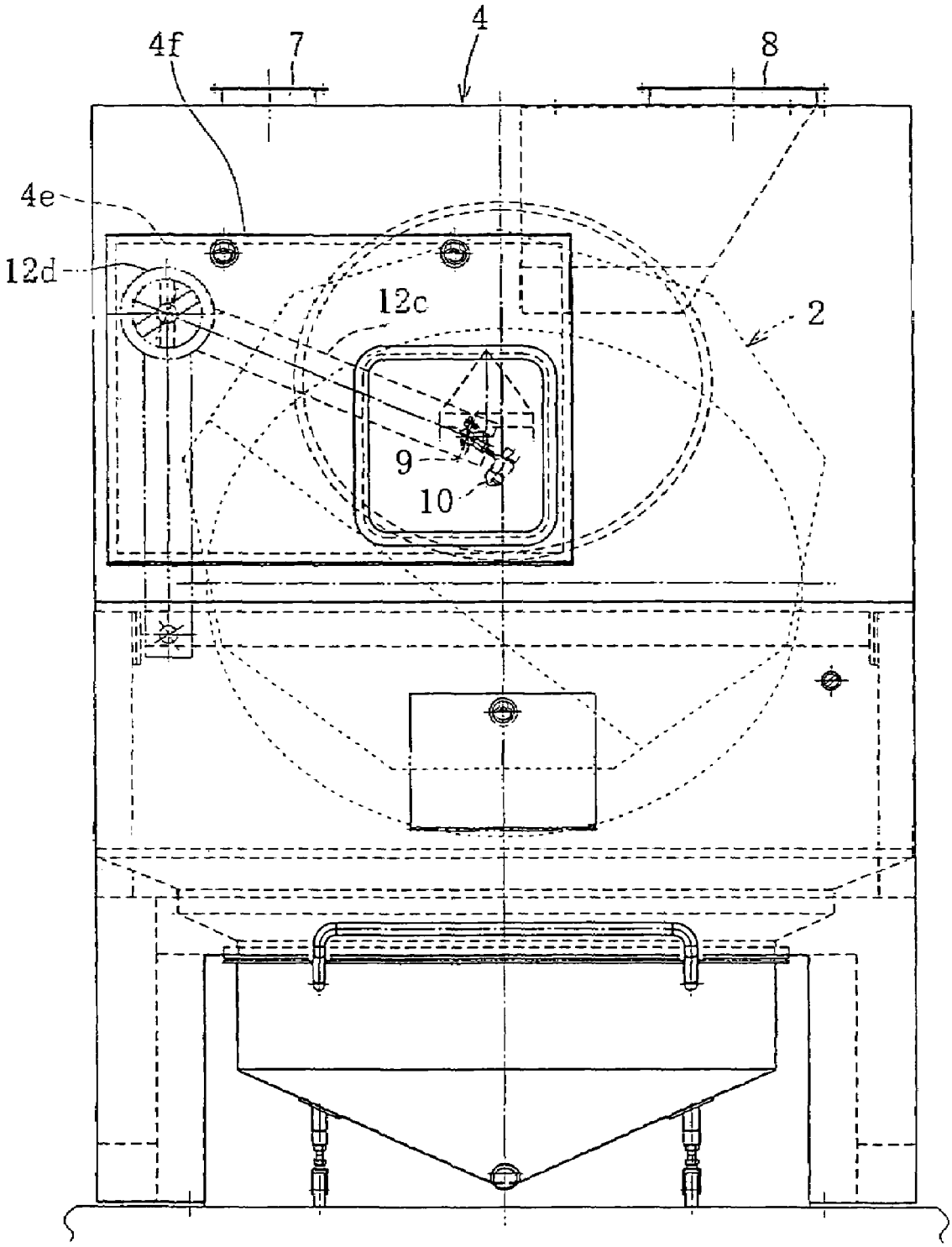
FIG. 2 is a front view of the coating apparatus seen from the front.
Figure 7:
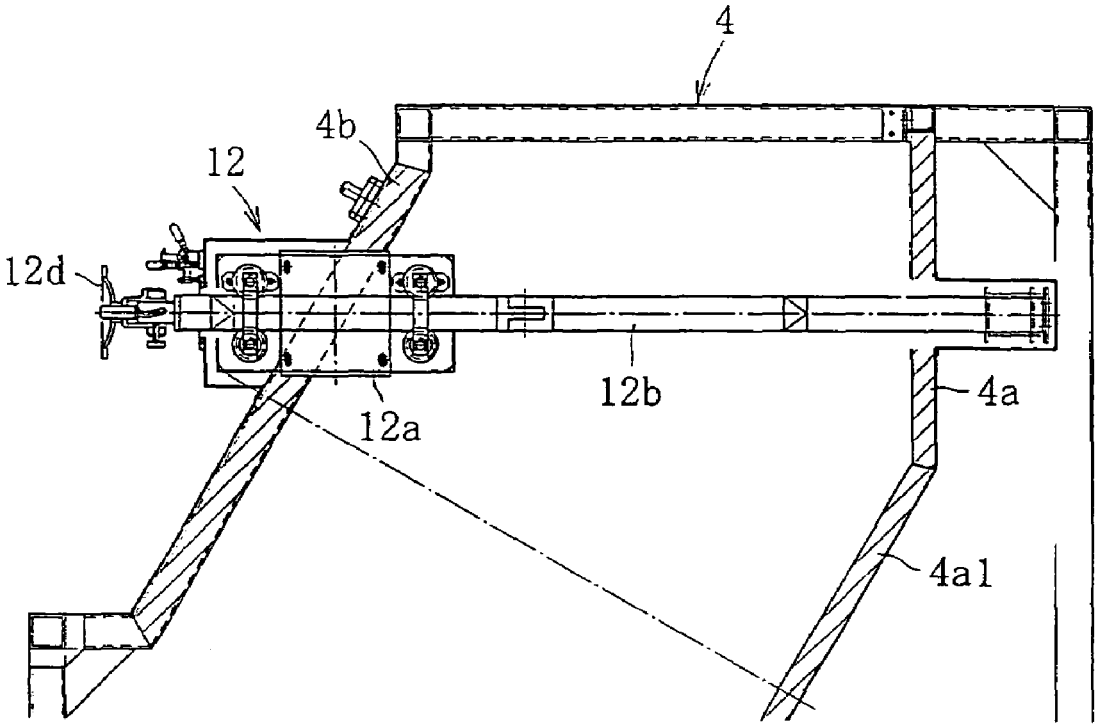
FIG. 7 is a partial longitudinal cross-sectional view showing a guide mechanism of a detergent feed pipe.

The detergent feed pipe 9 is arranged such that it is advanced into and retracted from inside the casing 4; for this purpose, a slide mechanism 12 is provided, which supports the detergent feed pipe 9 such as to allow it to slide to the front and back. The slide mechanism 12 includes a guide member 12*a* fixed to the partition wall 4*b* in the casing 4, a guide rod 12*b* supported by the guide member 12*a* such as to be movable to the front and back, and a connection rod 12*c* that fixedly couples the guide rod 12*b* and detergent feed pipe 9 inside the passage space S, as shown in FIG. 6(*a*) and FIG. 7. To the front end of the detergent feed pipe 3 is attached a handle 12*d*, and in the front wall of the casing 4 are provided an opening 4*e* and a lid 49 that opens and closes this opening 4*e* (see FIG. 2), so that the detergent feed pipe 9 is manually moved in and out through this opening 4*e*. Incidentally, as shown in FIG. 1, another detergent feed pipe 13 with spin balls 13*a* connected thereto is disposed in the passage space S for cleaning the space. Further, in the upper wall of the casing 4 are disposed spray nozzles 14 for spraying detergent, or cooling or heating liquid to the outer face of the peripheral wall 2*a* of the rotating drum 2.

The ventilation system 6 is arranged on the side of the rear end part of the rotating drum 2. The ventilation system 6 includes the first disc plate 21 that constitutes the rear end part of the rotating drum 2, and a second disc plate 22 arranged opposite the first disc plate 21, as shown in FIG. 3 and FIG. 4. The first disc plate 21 rotates with the rotating drum 2, while the second disc plate 22 does not. In this embodiment, the second disc plate 22 is slidable along the axial direction relative to the first disc plate 21.

Figure 8:
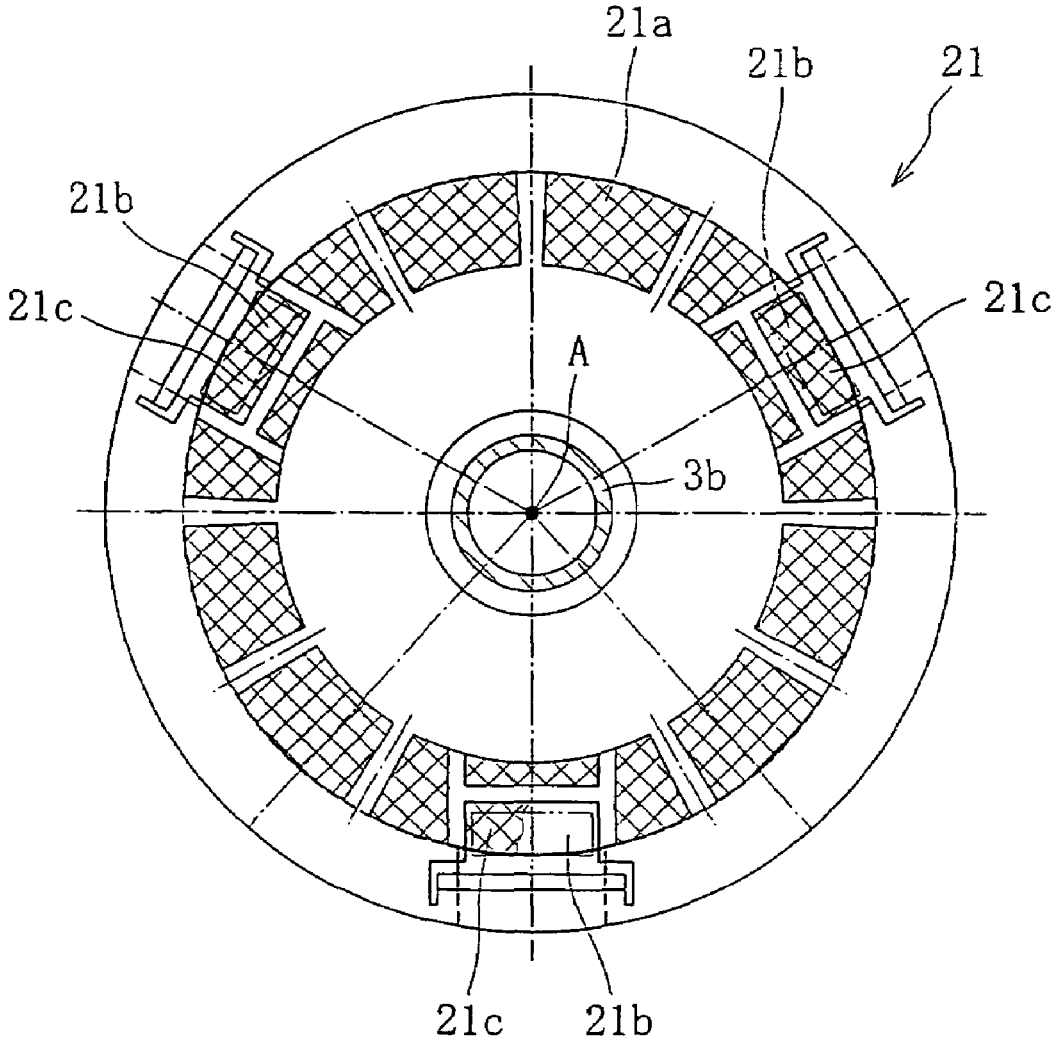
FIG. 8 is a backside view of a first disc plate seen from behind.

As shown in FIG. 8, the first disc plate 21 has an air vent 21*a* consisting of porous parts that are arranged in a ring shape around the axial line A of the rotating drum 2, end the drive shaft 3*b* is connected to the outer of rear face of the plate. In this embodiment, the air vent 21*a* is formed by attaching porous plates such as punched metal sheet onto a plurality of circumferentially spaced through holes formed in the main body of the first disc plate 21 along the aforementioned ring shape. The air vent 21*a* may extend continuously over the entire circumference of the ring shape. The outer peripheral edge of the air vent 21*a* substantially matches the lower end edge of the inclined peripheral wall 2*a*.

The first disc plate 21 is formed with open windows 21*b* at a plurality of circumferential locations (three circumferentially equally spaced locations in this embodiment) in circumferential parts of the air vent 21*a*, to which open/close lids 21*c* are attached, which are formed of porous plates such as punched metal sheet, to open and close the open windows 21*b*. The open windows 21*b* are formed in predetermined areas covering the outer peripheral edge toward the inside of the air vent 21*a*, and the rotation center axes 21*x* of the open/close lids 21*c* are disposed near the inner peripheral edge of the open windows 21*b* (see FIG. 9). The open/close lids 21*c* have engagement receptacle parts 21*d* at one end on the outer peripheral side as shown in FIG. 10(*a*), and are biased in the open direction with resilient members such as torsion coil springs. In this embodiment, the engagement receptacle parts 21*d* are provided in pairs in a spaced relationship.

Figure 9:
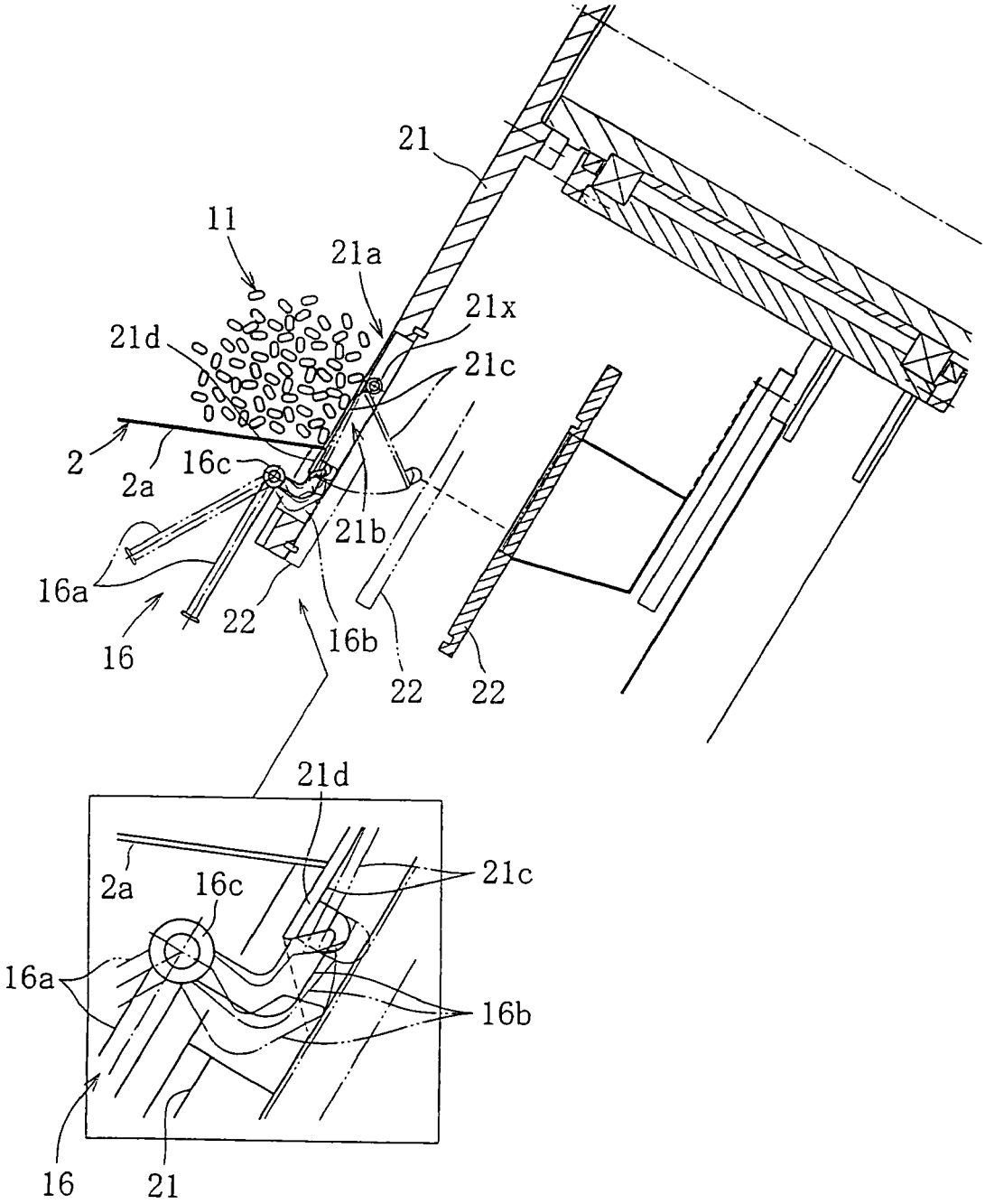
FIG. 9 is a partial longitudinal cross-sectional view showing the major elements surrounding the first disc plate.
Figure 10C:
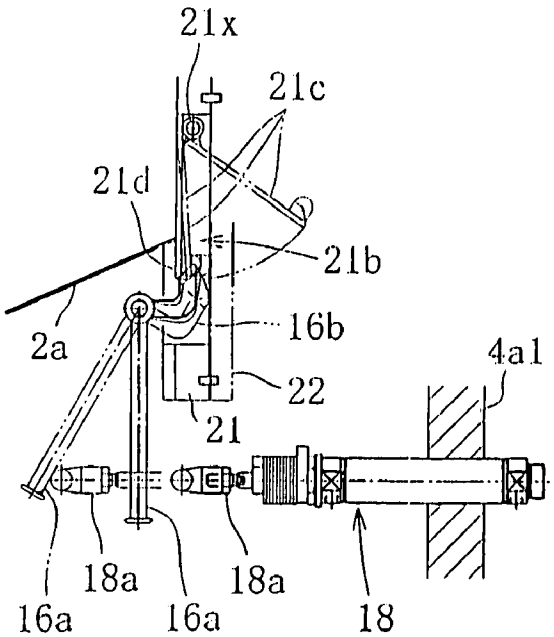
FIG. 10(*a*) is a partial backside view showing the vicinity of an open/close lid, FIG. 10(*b*) is a partial backside view showing the vicinity of a restricting member, and FIG. 10(*c*)
Figure 10B:
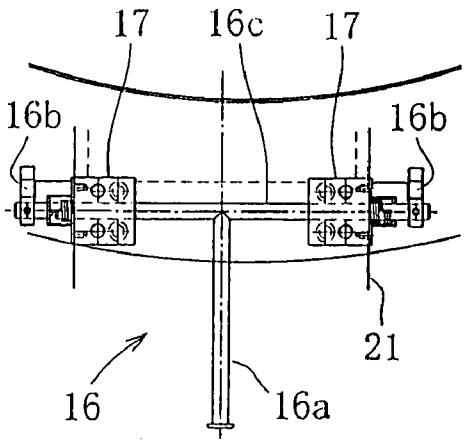
Figure 10A:
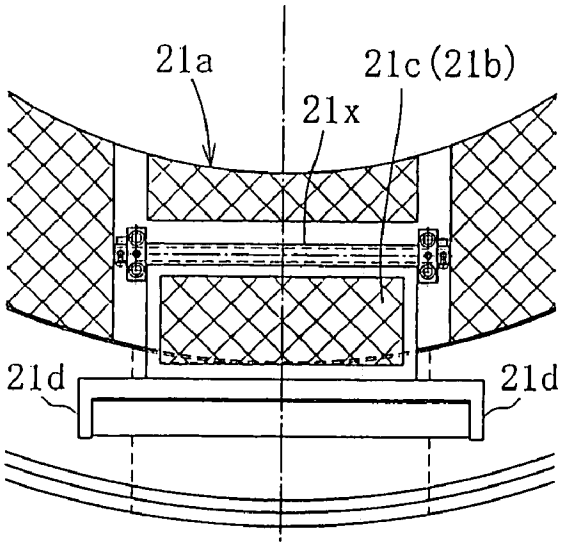

The first disc plate 21 is further provided with restricting members 16 as shown in FIG. 9 that restrict the opening movement of the open/close lids 21*c* and keep the open windows 21*b* closed. The restricting member 16 is rotatably held by means of bearing members 17 (see FIG. 10(*b*)) disposed on the inner or front face of the first disc plate 21 and on the outer side of the peripheral wall 2*a*, and has a lever 16*a* extending to the outer peripheral side from the rotation center or connection shaft 16*c* to be described later, and hooks 16*b* that extend to the inner peripheral side from the rotation center and are rotatable together with the lever 16*a*. In this embodiment, the hooks 16*b* are provided in a pair in a spaced relationship as shown in FIGS. 10(*b*) and (*c*), the pair of hooks 16*b* being respectively engaged with and disengaged from the pair of engagement receptacle parts 21*d* of the open window 21*b*. Further, the pair of hooks 16*b* is connected to each other by the connection shaft 16*c* that is rotatably supported by the bearing members 17; the lever 16*a* is fixed to the center in the axial direction of the connection shaft 16*c*. The restricting member 16 is biased with a resilient member such as a torsion coil spring in a direction in which the hooks 16*b* engage with the engagement receptacle parts 21*d* of the open window 21*b* (counterclockwise in FIG. 9 and FIG. 10(*c*)).

The restricting member 16 is driven by a movable member of an actuator such as a fluid pressure cylinder, or in this case a piston rod 18*a* of a first air cylinder 18, which is installed in the inclined wall 4*a*1 of the inner vertical wall 4*a* of the casing 4, as shown in FIG. 10(*c*). More concretely, the movement of the piston rod 18*a* of the first air cylinder 18 rotates the hooks 16*b* against the spring bias force of the resilient member in the direction in which the hooks disengage from the engagement receptacle parts 21*d* (clockwise in the drawing). More specifically, the piston rod 18*a* of the first air cylinder 18 is arranged so that its tip can abut on and separate from the lever 16*a* of the restricting member 16; a forward movement of the piston rod 18*a* abutting on the lever 16*a* rotates the hooks 16*b* in the direction in which they disengage from the engagement receptacle parts 21*d*, and a backward movement of the piston rod 18*a* causes the hooks 16*b* to rotate in the direction in which they engage with the engagement receptacle parts 21*d* because of the spring bias force of the resilient member.

Meanwhile, the second disc plate 22 is an annular plate having a larger outside diameter and a smaller inside diameter than those of the air vent 21*a* of the first disc plate 21, as shown in FIG. 3 and FIG. 4, and driven to slide in the direction along the axial line A by a plurality of, e.g., two fluid pressure cylinders, or in this case second air cylinders 19. More specifically, the second air cylinders 19 are installed in parallel with the axial line A in the inclined wall 4*a*1 of the inner vertical wall 4*a* of the casing 4 at the back of the second disc plate 22 as shown in FIG. 3, and the tips of the piston rods 19*a* of the second air cylinders 19 are connected to the second disc plate 22. Further, a plurality of, e.g., two, guide mechanisms 20 are disposed at the back of the second disc plate 22, as shown in FIG. 4. The guide mechanism 20 includes a guide member 20*a* fixed to the inclined wall 4*a*1 of the inner vertical wall 4*a* of the casing 4, and a guide rod 20*b* supported by the guide member 20*a* such as to be slidable in a direction parallel to the axial line A, and the second disc plate 22 is connected to the tip of this guide rod 20*b*.

At a location in the lower part of the second disc plate 22 is formed a connection hole 22*a*, as shown in FIG. 11, which illustrates the second disc plate 22 viewed from behind. When the rotating drum 2 rotates counterclockwise in the drawing during the processing of granules, the connection hole 22*a* is located, for example, in the area on the lower side of the horizontal center line of the second disc plate 22 and on the right side of the vertical center line in the drawing (lower and front side of the rotating direction). Generally speaking, the connection hole 22*a* of the second disc plate 22 is formed at a location where it overlaps the granule layer 11 during the rotation of the rotating drum 2 or during the processing of granules. Further, in this embodiment, the connection hole 22*a* is formed in the aforementioned area in a substantially quarter circular arc shape, its inside and outside diameters approximately matching those of the air vent 21*a* of the first disc plate 21.

Further, an air vent of the air duct 8 is connected to the outer or rear face of the second disc plate 22 such as to cover the connection hole 22*a*, so that the air vent 21*a* of the first disc plate 21 communicates to the air duct 8 at a predetermined location where it overlaps the connection hole 22*a* of the second disc plate 22. Therefore, the interior of the rotating drum 2 and the air duct 8 communicate to each other always at the predetermined location where the air vent 21*a* of the first disc plate 21 overlaps the connection hole 22*a* of the second disc plate 22, during the rotation of the rotating drum 2.

The second disc plate 22 is pressed by the extended second air cylinders 19 to face the first disc plate 21 with a slight gap therebetween during the processing of granules, as indicated by the solid lines in FIG. 3. The gap between the opposing faces of the first disc plate 21 and second disc plate 22 is sealed by a labyrinth seal Rx. Two labyrinth seals Rx are provided respectively on the outer and inner peripheral sides of the air vent 21*a* of the first disc plate 21 and connection hole 22*a* of the second disc plate 22. The second disc plate 22 is driven to slide in the axial direction by the retracting movement of the second air cylinders 19 to separate from the first disc plate 21 when discharging granule products or cleaning the apparatus, as indicated by chain lines in FIG. 3.

The opening/closing operation of the open/close lids 21*c* attached to the first disc plate 21 is associated with the sliding movement of the second disc plate 22 and the movement of the piston rod 18*a* of the first air cylinder 18 to rotate the restricting member 16. That is, as shown in FIG. 9, when the second disc plate 22 slides in the axial direction to separate from the first disc date 21, because the spring bias force of the resilient members biasing the restricting members 16 in the engaging direction (counterclockwise) is larger than that of the resilient members that bias the open/close lids 21 in the open direction (counterclockwise), the hooks 16*b* of the restricting members 16 remain engaged with the engagement receptacle parts 21*d* of the open/close lids 21*c* as indicated by the solid lines in the drawing, so that the open windows 21*b* are kept closed by the open/close lids 21*c*. In this state, when the piston rod 18*a* of the first air cylinder 18 advances to cause one of the restricting members 16 to rotate in the separating direction (clockwise), the hooks 16*b* of the restricting member 16 disengage from the engagement receptacle parts 21*d* of the open/close lid 21*c*, whereupon, as indicated by the chain lines in the drawing, the open/close lid 21*c* rotates in the open direction (counterclockwise) to open the open window 21*b*. The rotating movement of the open/close lid 21*c* at this time is restricted by a stopper (not shown) at a position where it is opened at an angle of less than 90°. On the other hand, when the second disc plate 22 slides in the axial direction to approach the first disc plate 21 in this state, the open/close lids 21*c* are pushed by the second disc plate 22 to rotate in the close direction (clockwise) and closed gradually. The open/close lids 21*c* are almost closed at the time point when the second disc plate 22 has reached the closest position to the first disc plate 21, but are not completely closed. The piston rod 18*a* of the first air cylinder 18 retracts thereafter to cause the restricting member 16 to turn in the engaging direction (counterclockwise) so that the hooks 16*b* engage with the engagement receptacle parts 21*d* of the open/close lid 21*c*. It is at this time when the open/close lid 21*c* is completely closed.

The air duct 8 is constructed separable inside the casing 4 as shown in FIG. 1; it is separated when the second disc plate 22 slides to separate from the first disc plate 21. More specifically, the air duct 8 includes a first part 8*a* attached to the upper wall of the casing 4 and a second part 8*b* attached to the second disc plate 22, and the joint faces of the first and second parts 8*a*, 8*b* are joined to each other with a sealing member therebetween such as an O-ring attached to at least one of them, during the processing of granules. When the second disc plate 22 slides to separate from the first disc plate 21 in this state, as indicated by the imaginary lines in the drawing, the second part 8*b* moves with the second disc plate 22 and separates from the first par 8*a*. At this time, the second part 8*b* moves diagonally downwards in the direction along the axial line A in which the second disc plate 22 slides, and therefore the separation of the second part 8*b* from the first part 8*a* takes place smoothly.

Furthermore, a sampling pipe 29 is inserted inside the rotating drum 2 through the rear end part. The sampling pipe 29 is passed through the hollow drive shaft 3*b* and the center of the first disc plate 21, and embedded into the granule layer 11 inside the rotating drum 2. During or after the processing of granules, a required amount of granules are taken out through the sampling pipe 29 from inside the granule layer 11 as samples.

During a coating process of granules such as tablets using the coating apparatus 1 of this embodiment, process gas such as dry air is supplied into and exhausted from the inside of the rotating drum 2 through the air vent 5 at one end of the rotating drum 2 and the air vent 21*a* at the other end. In this embodiment, the one end side of the rotating drum 2 is constructed as the inlet side and the other and side as the outlet side. In this case, the air vent 5 at one end of the rotating drum 2 is an air inlet (hereinafter "air inlet 5"), the air duct 7 at one end is an air inlet duct (hereinafter "air inlet duct 7"), the air vent 21*a* at the other end is an air outlet (hereinafter "air outlet 21*a*"), and the air duct 8 at the other end is an air outlet duct (hereinafter "air outlet duct 8"). Not to mention, the one end side of the rotating drum 2 may be constructed as the outlet side, and the other end side as the inlet side, depending on the conditions of use or processing.

Granules to be coated are poured into the rotating drum 2 from the air vent (opening) 5 at one end of the rotating drum 2. The rotating drum 2 is driven by the rotary drive mechanism 3 to rotate around the axial line A that is inclined to the horizontal at a preset angle θ; with the rotation of the rotating drum 2, the granules inside are stirred and mixed to form the granule layer (rolling bed) 11. Since the axial line A of the rotating drum 2 is inclined at the preset angle θ, the surface layer of the granule layer 11 bridges, in the direction of the axial line A, between the peripheral wall 2*a* of the rotating drum 2 and the first disc plate 21 at the rear end part as shown in FIG. 1, and in the rotating direction, the surface layer is lifted up diagonally from the back side to the front side of the rotating direction, as shown in FIG. 11.

A liquid such as coating liquid is sprayed from the spray nozzles 10 onto the above granule layer 11. The liquid sprayed on the granule layer 11 is spread over the surface of each one of the granule particles by the stirring and mixing effects to the granule layer 11 given by the rotation of the rotating drum 2.

The liquid sprayed and spread over the surface of the granule particles is dried by the process gas such as hot air supplied into the rotating drum 2. The process gas flows into the rotating drum 2 from the air vent 7*a* of the air inlet duct 7 through the air inlet 5 at one end of the rotating drum 2, passes through inside the granule layer 11, and flows out through the air outlet 21*a* of the first disc plate 21 and connection hole 22*a* of the second disc plate 22 into the air outlet duct 8. As the process gas passes through inside the granule layer 11, the liquid sprayed and spread over each of the granule particles is evenly dried, whereby a high quality coating is formed.

During the coating process, cold or hot water may be sprayed from the spray nozzles 14 disposed in the upper wall of the casing 4 toward the peripheral wall 2*a* of the rotating drum 2 as required, so as to cool or heat the rotating drum 2 from outside. For example, the rotating drum 2 may be cooled for sugar coating, or heated for chocolate coating, and for film coating, it may be cooled or heated according to the processing conditions. Cool or hot air, or a heater such as an infrared heater may be used as cooling/heating means, instead of the cool or hot water.

The granule products that have undergone the coating process are discharged from inside the rotating drum 2 in the following manner: First, the second air cylinders 19 are activated to cause the second disc plate 22 to slide to separate from the first disc plate 21. Then the first air cylinder 18 is activated to cause one restricting member 16 to rotate to open the open/close lid 21*c*. Here, in order to open the plurality of open/close lids 21*c*, the rotating drum 2 is rotated intermittently each of the open/close lids 21*c* is opened one after another, as the rotating drum 2 is paused at the location where each open/close lid 21*c* comes to face the first air cylinder 18. If necessary, the first air cylinder 18 may be provided in the same number as that of the plurality of the open/close lids 21*c* and arranged in the inner vertical wall 4*a* of the casing 4 with the same angular spacing as that of the open/close lids 21*c*, so that all of the open/close lids 21*c* are opened at the same time as the first air cylinders 18 are activated. After opening the plurality of open/close lids 21*c* to open the plurality of open windows 21*b*, the rotating drum 2 is rotated. The granule products inside the rotating drum 2 then slide down due to the centrifugal force and self-weight and are discharged to the outside through the open window 21 that has come to the lower side as the rotating drum 2 rotates.

After the discharge of the granule products, the rotating drum 2 is cleaned on the inside and outside. The rotating drum 2 is cleaned on the inside with the detergent sp rayed from the spin balls 9*a* and fan nozzles 9*b* connected to the detergent feed pipe 9, and on the outside with the detergent sprayed from the spray nozzles 14 disposed in the upper wall of the casing 4, respectively. The ventilation system 6 is also cleaned, with the first disc plate 21 and second disc plate 22 being separated from each other. Further, the air inlet duct 7, air discharge duct 8, passage space S, and other parts are cleaned as required.

FIG. 12 illustrates a coating apparatus 1' according to a second embodiment. The coating apparatus 1' of this embodiment differs from the above-described coating apparatus 1 of the first embodiment in that the cross-sectional plane P2 containing the large diameter part 2*a*2 of the peripheral wall 2*a* of the rotating drum 2 is inclined at a preset angle β relative to the axial line A, and that the hollow drive shaft 3*b* is used as the product discharge part. Other features are substantially the same as those of the first embodiment, and the repetitive description thereof will be omitted.

Because the cross-sectional plane P2 containing the large diameter part 2*a*2 of the peripheral wall 2*a* is inclined at preset angle β relative to the axial line A, the large diameter part 2*a*2 changes its position constantly in the axial direction relative to the granule layer 11 during the rotation of the rotating drum 2. Therefore, a relatively large movement is imparted in the axial direction to the granule layer 11 inside the rotating drum 2, in addition to the movement in the rotating direction. The granule layer 11 is thus stirred and mixed with enhanced efficiency.

The product discharge part is mainly constructed with the hollow drive shaft 3*b*, and an open/close lid 25 for opening and closing an axial end opening 3*b*1 of the drive shaft 3*b*.

The drive shaft 3*b* is connected to the outer (rear) face of the first disc plate 21, and the axial end opening 3*b*1 communicates to an open window 21*f* penetrating the center of the first disc plate 21. The open/close lid 25 is disposed for the open window 21*f* of the first disc plate 21, normally making tight contact therewith to close the open window 21*f* and axial end opening 3*b*1.

The opening and closing of the open/close lid 25 are effected by activating an actuator such as a fluid pressure cylinder, or in this case a third air cylinder 26. That is, the open/close lid 25 is connected to an activating rod 25*a* that is inserted into the drive shaft 3*b* and biased resiliently backwards by a resilient member such as a spring (not shown). The open/close lid 25 is thus drawn backwards by the activating rod 25*a* to close the open window 21*f* and axial end opening 3*b*1, when the third air cylinder 26 is not activated. On the other hand, when the third air cylinder 26 is activated, its piston rod abutting the activating rod 25*a* extends and moves the same forward against the resilient force of the spring. The open/close lid 25 is thereby pushed forward via the activating rod 25*a* to open the open window 21*f* and axial end opening 3*b*1. When the piston rod of the third air cylinder 26 retracts in this state, the activating rod 25*a* moves backwards by the resilient force of the spring. Thereby, the open/close lid 25 is drawn backwards again via the activating rod 25*a*, to close the open window 21*f* and axial end opening 3*b*1. When closed, the open/close lid 25 makes tight contact with the open window 21*f* by the resilient force of the spring, and the open/close lid 25 and activating rod 25*a* rotate together with the rotating drum 2 and drive shaft 3*b*.

Furthermore, in this embodiment, a discharge guide part 21*g* is provided on the inner (front) face of the first disc plate 21, as shown in FIG. 13. The discharge guide part 21*g* is convex relative to the inner face of the first disc plate 21, and, by way of example, provided in plurality at a preset angular spacing in radial arrangement. Each of the discharge guide parts 21*g* extends from the outer peripheral edge of the air vent 21*a* to the periphery of the open window 21*f*. These discharge guide parts 21*g* may be inclined at a preset angle relative to the radius line.

After the completion of the coating process, the third air cylinder 26 is activated to push the open/close lid 25 forward to open the open window 21*f* and axial end opening 3*b*1. When the rotating drum 2 is rotated in this state, the granule products inside are scooped up to the front of the rotating direction by the sides of the discharge guide parts 21*g*, and when they are lifted up to a certain height, they slide down along the sides of the discharge guide parts 21*g* by their self-weight, being guided toward the open window 21*f* and axial end opening 3*b*1. The granule products guided to the axial end opening 3*b*1 are then discharged to the outside through inside the drive shaft 3*b*.

In this embodiment, in order to facilitate the cleaning operation of the interior of the drive shaft 3*b* that forms the discharge path of the granule products, a cleaning nozzle 27 is provided inside the drive shaft 3*b*. Further, the inclination angle θ of the axial line A of the rotating drum 2 is set 45° relative to the horizontal.

FIG. 15 illustrates a coating apparatus 1" according to a third embodiment. The coating apparatus 1" of this embodiment differs from the above-described coating apparatus 1' of the second embodiment in that, between the air vent 5 at one end of the rotating drum 2 and the air vent 21*a* at the other end, there are two air passages that are selectable for the process gas, one through the granule layer 11 and the other through the upper space S' above the granule layer 11 inside the rotating drum 2. Other features are substantially the same as those of the second embodiment, and the repetitive description thereof will be omitted. The system and construction for switching between the two air passages in the third embodiment are also applicable to the coating apparatus 1 of the first embodiment.

The second disc plate 22 constituting the ventilation system 6 has a first connection hole 22*a* in the lower part and a second connection hole 22*b* in the upper part, as shown in FIG. 16. When the rotating drum 2 rotates counterclockwise in the drawing during the processing of granules, the first connection hole 22*a* is located, for example, in the area on the lower side of the horizontal center line of the second disc plate 22 and on the right side of the vertical center line in the drawing (lower and front side of the rotating direction). Generally speaking, the first connection hole 22*a* of the second disc plate 22 is formed at a location where it overlaps the granule layer 11 during the rotation of the rotating drum 2 or during the processing of granules. The second connection hole 22*b* is located, for example, in the area on the upper side of the horizontal center line of the second disc plate 22 and on the left side of the vertical center line in the drawing (upper and front side of the rotating direction). Generally speaking, the second connection hole 22*b* of the second disc plate 22 is formed at a location where it overlaps the upper space S' above the granule layer 11 during the rotation of the rotating drum 2 or during the processing of granules. In this embodiment, the first and second connection holes 22*a*, 22*b* are formed in the aforementioned areas in a substantially quarter circular arc shape, their inside and outside diameters approximately matching those of the air vent 21*a* of the first disc plate 21.

Further, to the outer or rear face of the second disc plate 22 are connected an air vent of the air duct 8 and an air vent of the air duct 50 (50*b*) such as to cover the first connection hole 22*a* and the second connection hole 22*b*, respectively. The air vent 21*a* of the first disc plate 21 communicates to the air duct 8 at a first predetermined location where it overlaps the first connection hole 22*a* of the second disc plate 22, and to the air duct 50 at a second predetermined location where it overlaps the second connection hole 22*b* of the second disc plate 22.

The air duct 50 is constructed separable inside the casing 4 as shown in FIG. 15, similarly to the air duct 8; it is separated when the second disc plate 22 slides to separate from the first disc plate 21. That is, the air duct 50 includes a first part 50*a* attached to the upper wall of the casing 4 and a second part 50*b* attached to the second disc plate 22, and the joint faces of the first and second parts 50*a*, 30*b* are joined to each other with a sealing member therebetween such as an O-ring attached to at least one of them, during the processing of granules. When the second disc plate 22 slides to separate from the first disc plate 21 in this state, the second part 50*b* moves with the second disc plate 22 and separates from the first part 50*a*. The first part 50*a* is provided with an air damper 50*c*.

The air duct 8 includes an air damper 8*c*, and the first part 50*a* of the air duct 50 is connected to the air duct 8 at a location farther from the casing 4 than the air damper 8*c*. The air duct 7 includes an air damper 7*b*, and another air duct 51 is connected to the air duct 7 at a location closer to the casing 4 than the air damper 7*b*. The air duct 51 also has an air damper 51*a*. The air dampers 7*b*, 51*a*, 8*c*, 50*c* have both functions of ON/OFF control of the flow of process gas through their air ducts and of adjusting the flow rate of the process gas.

In this embodiment, the one end side of the rotating drum 2 is constructed as the inlet side and the other end side as the outlet side. In this case, the air vent 5 at one end of the rotating drum 2 is an air inlet (hereinafter "air inlet 5"), the air ducts 7, 51 at one end are air inlet ducts (hereinafter "air inlet duct 7, 51"), the air vent 21*a* at the other end is an air outlet (hereinafter "air outlet 21*a*") and the air ducts 8, 50 at the other end are air outlet ducts (hereinafter "air outlet duct 8, 50"). Not to mention, the one end side of the rotating drum 2 may be constructed as the outlet side, and the other end side as the inlet side, depending on the conditions of use or processing.

The coating apparatus 1" of this embodiment is particularly suited for sugar coating. Sugar coating includes, for example, a series of process steps of spraying, first pausing, second pausing, and drying.

The spraying process is a step of spraying a coating liquid from the spray nozzles 10 while rotating the rotating drum 2 with no ventilation to adhere the liquid onto the granule particles such as tablets. In this spraying process, the air inlet dampers 7*b*, 51*a* and air outlet dampers 8*c*, 50*c* are all closed.

The first pausing process is a step of spreading the coating liquid on the surface of the granule particles by the rolling movement of the granule layer 11 by rotating the rotating drum 2 with no ventilation. The air inlet dampers 7*b*, 51*a* and air outlet dampers 8*c*, 50*c* are all closed in the first pausing process, too.

The second pausing process is a step of performing ventilation using a relatively low-temperature (e.g. room temperature) process gas such as cool air while rotating the rotating drum 2, so as to continue the spreading of the coating liquid on the surface of the particles. In the second pausing process, the air inlet damper 7*b* and air outlet damper 8*c* are closed, while the air inlet damper 51*a* and air outlet damper 50*c* are opened. Cool air is fed from the air inlet duct 51. The cool air fed from the air inlet duct 51 flows into the rotating drum 2 through the air vent 7*a* of the air inlet duct 7 and the air inlet 5 at one end of the rotating drum 2, passes through the upper space S' above the granule layer 11, and flows out into the air outlet duct 50 through the air outlet 21*a* of the first disc plate 21 and the second connection hole 22*b* of the second disc plate 22. As the cool air passes through the upper space S' above the granule layer 11, the moist vapor filled in the upper space S' is exhausted to the outside of the rotating drum 2 with the cool air. Wet abrasion caused by moisture absorption by the granule particles is thereby prevented, and the problem of an increase in the time required in the drying process is resolved, and also, because the cool air does not pass through inside the granule layer 11, no failure occurs in the spreading of the coating liquid.

The drying process is a step of performing ventilation of a relatively high-temperature process gas such as hot air while rotating the rotating drum 2, so as to dry the coating liquid spread over the surface of the particles. In the drying process, the air inlet damper 51*a* and air outlet damper 50*c* are closed, while the air inlet damper 7*b* and air outlet damper 8*c* are opened. Hot air is fed from the air inlet duct 7. The hot air fed from the air inlet duct 7 flows into the rotating drum 2 through the air vent 7*a* of the air inlet duct 7 and the air inlet 5 at one end of the rotating drum 2, passes through inside the granule layer 11, and flows out into the air outlet duct 8 through the air outlet 21*a* of the first disc plate 21 and the first connection hole 22*a* of the second disc plate 22. As the hot air passes through inside the granule layer 11, the liquid sprayed and spread onto the surface of granule particles is evenly dried, whereby a high quality coating is formed. Because the moist vapor filled in the upper space S' above the granule layer 11 has been exhausted to the outside of the rotating drum 2 in the second pausing process, whereby moisture absorption by the granule particles is restricted, this drying process is accomplished satisfactorily in a relatively short period of time.

In the above-described first to third embodiments, a mixing blade or a so-called baffle that rotates with the rotating drum 2 may be provided inside the rotating drum 2, or, a fixed baffle (mixing blade that does not rotate) may be provided. The stirring and mixing effects for the granule layer 11 will thereby be further enhanced. Such baffle may be provided in she manner shown in FIG. 17, for example.

In FIG. 17, the peripheral wall 2*a* of the rotating drum 2 includes a first baffle 2*a*3 in the portion where its diameter decreases gradually toward the front end side from the large diameter part 2*a*2, and a second baffle 2*a*4 in the portion where its diameter decreases gradually toward the rear end side from the large diameter part 2*a*2. The first and second baffles 2*a*3, 2*a*4 are provided in plurality along the circumference, and inclined to the axial line A, respectively. For example, the first and second baffles 2*a*3, 2*a*4 that are adjacent each other in the axial direction are inclined in the same direction (see FIG. 17(*b*)), while the first baffles 2*a*3 adjoining in the circumferential direction are inclined in opposite directions, and the second baffles 2*a*4 adjoining in the circumferential direction are inclined in opposite directions. The inner space S1 of the first baffle 2*a*3 and the inner space S2 of the second baffle 2*a*4 are opened on the outside of the peripheral wall 2*a*.

The first baffle 2*a*3 is formed continuously inward in the peripheral wall 2*a* as shown in FIGS. 17(*c*) and (*d*), so that the peripheral wall 2*a* is indented when seen from the outside by the inner space S1 of the first baffle 2*a*3. In the example shown in FIG. 17(*c*), the first baffle 2*a*3 is formed by fixing a baffle member 2*a*32 formed in a predetermined shape to the edge of notches 2*a*31 provided in a preset area of the peripheral wall 2*a* by suitable means such as welds W. In the example shown in FIG. 17(*d*), the first baffle 2*a*3 is formed by bending a preset area of the peripheral wall 2*a* plastically inward using, e.g., a pressing process. The structure and forming method of the second baffle 2*a*4 are the same as those of the first baffle 2*a*3.

Because the inner space S1 of the first baffle 2*a*3 and the inner space S2 of the second baffle 2*a*4 open on the outside of the peripheral wall 2*a*, the first and second baffles 2*a*3, 2*a*4 are sufficiently heated or cooled when the rotating drum 2 is cooled or heated from outside. Thus adhesion of coating material to the inner face of the peripheral wall 2*a* and to the first and second baffles 2*a*3, 2*a*4 is effectively prevented.

While the axial line A of the rotating drum 2 is inclined to the horizontal at a preset angle θ of, e.g., 30° or 45°, the axial line A of the rotating drum 2 may be set parallel to the vertical (θ=90°) as shown in the conceptual view of FIG. 14, i.e., the rotating drum 2 may be rotated around the vertical. In this case, a fixed baffle 29 or a mixing blade that does not rotate may be provided inside the rotating drum 2 to enhance the stirring and mixing effects for the granule layer 11. In the example shown in FIG. 14, the fixed baffle 29 is supported in the partition wall 4*b* of the casing 4 by a support arm 29*a*.

Alternatively, although not shown, the axial line A of the rotating drum 2 may be parallel to the horizontal (θ=0°), i.e., the rotating drum 2 may be rotated around the horizontal. Further, the construction in which the cross-sectional plane P2 containing the large diameter part 2*a*2 of the peripheral wall 2*a* is inclined to the axial line A at a preset angle β may be applied to the rotating drum 2 of the first embodiment. Conversely, the construction in which the cross-sectional plane P1 containing the large diameter part 2*a*2 of the peripheral wall 2*a* is orthogonal to the axial line A may be applied to the rotating drum 2 of the second or third embodiment.

As described above, the present invention provides a coating apparatus that is excellent in the ease of cleaning and validation after the cleaning, and in the quality and efficiency of coating process.

The invention claimed is:

1. A coating apparatus including a ventilated rotating drum in which granules to be processed are accommodated and which is driven to rotate around its axial line, a ventilation mechanism, and a casing accommodating said rotating drum and said ventilation mechanism therein, wherein said rotating drum comprises one end and the other end along the direction of the axial line and a peripheral wall that connects said one end and said other end, said other end being located on the side of a rotary drive mechanism for driving said rotating drum, wherein said one end, said other end, and said peripheral wall as a whole configure a vessel for accommodating said granules to be processed, said peripheral wall has no air passage and is bare inside said casing, said one end and said other end are respectively provided with an air vent, one of which constitutes an air inlet for supplying a process gas from outside into said rotating drum, and the other one of which constitutes an air outlet for exhausting the process gas from inside said rotating drum to the outside, when coating the granules, said ventilation mechanism is provided at the other end of said rotating drum communicating with the air vent at said other end to an air duct at a first location where the air vent at said other end overlaps a layer of the granules inside said rotating drum, wherein the process gas supplied into said rotating drum through said air inlet passes through said layer of the granules inside said rotating drum and is exhausted from said air outlet, wherein said ventilation mechanism includes a first disc plate constituting the other end of said rotating drum and having an air vent consisting of porous parts arranged in a ring shape around the axial line of said rotating drum.

2. The coating apparatus according to claim 1, wherein the axial line of said rotating drum forms a preset angle θ ranging from 0° to 90° with respect to a horizontal line.

3. The coating apparatus according to claim 2, wherein the axial line of said rotating drum is inclined at the preset angle θ with respect to the horizontal line.

4. The coating apparatus according to claim 1, wherein the axial line of said rotating drum is oscillatory within a preset angle range.

5. The coating apparatus according to claim 1, wherein the air vent at the other end of said rotating drum is formed by a porous part.

6. The coating apparatus according to claim 1, wherein the air vent at one end of said rotating drum is provided in an opening whose center coincides with the axial line of said rotating drum.

7. The coating apparatus according to claim 1, wherein a second disc plate arranged opposite said first disc plate and having a connection hole for communicating the air vent of said first disc plate to said air duct at a preset location.

8. The coating apparatus according to claim 7, wherein said second disc plate is constructed slidable in the axial direction.

9. The coating apparatus according to claim 1, wherein the air vent at said other end is further connected to a second air duct at a second location where the air vent at said other end overlaps an upper space above said layer of the granules inside said rotating drum, said first location and said second location being selectable, wherein when said second preset location is selected, the process gas flows through the upper space above said layer of the granules between the air vent at said other end at said second preset location and the air vent at said one end.

10. The coating apparatus according to claim 1, wherein said first disc plate is provided with a product discharge part that can be opened and closed for discharging granule products inside said rotating drum to the outside.

11. The coating apparatus according to claim 10, wherein said product discharge part includes an open window formed in said first disc plate and an open/close lid provided for said open window.

12. The coating apparatus according to claim 11, wherein opening/closing operation of said open/close lid is associated with a movement of a movable member of an actuator and a sliding movement of a second disc plate.

13. The coating apparatus according to claim 1, wherein the other end of said rotating drum is connected to a hollow drive shaft of the rotary drive mechanism for driving said rotating drum, and granule products inside said rotating drum are discharged to the outside through inside said hollow drive shaft.

14. The coating apparatus according to claim 13, wherein said hollow drive shaft is provided with an open/close lid for opening and closing an opening at one shaft end facing the inside of said rotating drum.

15. The coating apparatus according to claim 1, wherein the peripheral wall of said rotating drum is shaped such that its diameter increases gradually from said one end and from said other end toward the center in the axial direction, and a cross-sectional plane of said peripheral wall containing a large diameter part is inclined with respect to the axial line at a preset angle.

16. The coating apparatus according to claim 1, wherein the peripheral wall of said rotating drum includes an inwardly protruding baffle, and an inner space of said baffle is open on the outside of said peripheral wall.

17. The coating apparatus according to claim 16, wherein said baffle is provided in said peripheral wall continuously inward.

18. The coating apparatus according to claim 17, wherein said baffle is formed by bending a preset area of said peripheral wall inward.

19. The coating apparatus according to claim 1, wherein at least one of cooling means and heating means is disposed on the outside of the peripheral wall of said rotating drum.

20. The coating apparatus according to claim 1, wherein the peripheral wall of said rotating drum is formed in a polygonal tube shape.

21. The coating apparatus according to claim 1, wherein one end of said rotating drum is covered by a part of casing to which a third air duct is attached, with sealing means for providing a seal between said one end and said part of casing.

22. The coating apparatus according to claim 21, wherein said sealing means is a labyrinth seal.

23. The coating apparatus according to claim 1, wherein the process gas supplied into said rotating drum through said air inlet passes through an entire area of said layer of the granules inside said rotating drum.

24. A coating apparatus including a ventilated rotating drum in which granules to be processed are accommodated and which is driven to rotate around its axial line, characterized in that said rotating drum includes one end and the other end along the direction of the axial line and a peripheral wall that connects said one end and said other end, said other end being located on the side of a rotary drive mechanism for driving said rotating drum;

said one end and said other end are respectively provided with an air vent, one of which constitutes an air inlet for supplying process gas from outside into said rotating drum, and the other one of which constitutes an air outlet for exhausting the process gas from inside said rotating drum to the outside; and the process gas supplied into said rotating drum through said air inlet is passed through a layer of the granules inside said rotating drum and exhausted from said air outlet, wherein one end of said rotating drum is covered by a part of casing to which an air duct is attached, with sealing means for providing a seal between said one end and said part of casing.

25. The coating apparatus according to claim 24, wherein said sealing means is a labyrinth seal.

26. A coating apparatus including a ventilated rotating drum in which granules to be processed are accommodated and which is driven to rotate around its axial line, characterized in that said rotating drum includes one end and the other end along the direction of the axial line and a peripheral wall that connects said one end and said other end, said other end being located on the side of a rotary drive mechanism for driving said rotating drum;

said one end and said other end are respectively provided with an air vent, one of which constitutes an air inlet for supplying process gas from outside into said rotating drum, and the other one of which constitutes an air outlet for exhausting the process gas from inside said rotating drum to the outside; and the process gas supplied into said rotating drum through said air inlet is passed through a layer of the granules inside said rotating drum and exhausted from said air outlet, wherein the other end of said rotating drum is connected to a hollow drive shaft of the rotary drive mechanism for driving said rotating drum, and granule products inside said rotating drum are discharged to the outside through inside said hollow drive shaft, wherein the coating apparatus further includes a ventilation mechanism, and said ventilation mechanism includes a first disc plate constituting the other end of said rotating drum and having an air vent consisting of porous parts arranged in a ring shape around the axial line of said rotating drum.

27. The coating apparatus according to claim 26, wherein said hollow drive shaft is provided with an open/close lid for opening and closing an opening at one shaft end facing the inside of said rotating drum.

* * * * *